US012788113B2

(12) United States Patent
Ozawa et al.

(10) Patent No.: US 12,788,113 B2
(45) Date of Patent: Nov. 10, 2026

(54) SHOE WITH KNITTED SHOE TONGUE

(71) Applicant: ASICS Corporation, Hyogo (JP)

(72) Inventors: Keita Ozawa, Hyogo (JP); Yousuke Atarashi, Hyogo (JP); Hiroki Nakamura, Hyogo (JP); Keishi Kitamoto, Hyogo (JP)

(73) Assignee: ASICS Corporation, Hyogo (JP)

( * ) Notice: Subject to any disclaimer, the term of this patent is extended or adjusted under 35 U.S.C. 154(b) by 0 days.

(21) Appl. No.: 18/286,853

(22) PCT Filed: Apr. 16, 2021

(86) PCT No.: PCT/JP2021/015685
§ 371 (c)(1),
(2) Date: Oct. 13, 2023

(87) PCT Pub. No.: WO2022/219797
PCT Pub. Date: Oct. 20, 2022

(65) Prior Publication Data

US 2024/0188686 A1 Jun. 13, 2024

(51) Int. Cl.
*A43B 3/00* (2022.01)
*A43B 23/26* (2006.01)

(52) U.S. Cl.
CPC ..... *A43B 23/26* (2013.01); *A43B 3/0063* (2013.01)

(58) Field of Classification Search
CPC ... A43B 3/0063; A43B 7/1495; A43B 23/027; A43B 23/26
USPC ..... 36/54
See application file for complete search history.

(56) References Cited

U.S. PATENT DOCUMENTS 766,709 A * 8/1904 Le ..... A43B 23/02 36/48
5,265,353 A * 11/1993 Marega ..... A43D 999/00 36/117.6
5,337,493 A * 8/1994 Hill ..... A43C 11/002 36/114

(Continued)

FOREIGN PATENT DOCUMENTS

CN 106163316 A 11/2016
JP H05228006 A 9/1993

(Continued)

OTHER PUBLICATIONS

International Preliminary Report on Patentability received in PCT Application No. PCT/JP2021/015685 dated Oct. 12, 2023.

(Continued)

*Primary Examiner* — Sharon M Prange
(74) *Attorney, Agent, or Firm* — Rimon P.C.

(57) ABSTRACT

A shoe includes a sole, an upper joined to the sole, and a shoe tongue provided in an internal space formed by the sole and the upper. The shoe tongue is formed of a knitted member and includes a ridge portion of inverted V shape along the front and rear directions of the shoe. The shoe tongue is formed of a single knitted member of which side ends on a medial side and a lateral side are each joined to a vicinity of a tangent between a bottom part and a side part in the internal space. In the shoe tongue, part of an area from the ridge portion to the side end on the medial side or the lateral side is formed to have higher stretchability than at least part of other adjacent areas.

9 Claims, 14 Drawing Sheets

(56) References Cited

U.S. PATENT DOCUMENTS

| | | | | |
|---|---|---|---|---|
| 5,970,629 | A * | 10/1999 | Tucker | A43C 11/00 36/51 |
| 6,237,253 | B1 * | 5/2001 | Feuerecker | A43B 23/26 36/117.1 |
| 9,295,298 | B2 | 3/2016 | Greene | |
| 9,510,636 | B2 | 12/2016 | Dua et al. | |
| 9,756,903 | B1 * | 9/2017 | Koo | A43C 11/002 |
| 10,028,545 | B2 | 7/2018 | Ikenaka et al. | |
| 10,258,108 | B2 * | 4/2019 | Aveni | A43B 23/028 |
| 2014/0130270 | A1 | 5/2014 | Baudouin et al. | |
| 2014/0230166 | A1 | 8/2014 | Aveni et al. | |
| 2015/0342285 | A1 | 12/2015 | Huffman et al. | |
| 2021/0106098 | A1 | 4/2021 | Kajiwara | |
| 2023/0115950 | A1 * | 4/2023 | Suzuki | A43B 23/26 36/50.1 |
| 2024/0023676 | A1 * | 1/2024 | Tateno | A43B 7/14 |

FOREIGN PATENT DOCUMENTS

| | | | |
|---|---|---|---|
| JP | 2015534876 | A | 12/2015 |
| JP | 5950479 | B2 | 7/2016 |
| JP | 2017517364 | A | 6/2017 |
| JP | 2019130370 | A | 8/2019 |
| KR | 200356238 | Y1 | 7/2004 |

OTHER PUBLICATIONS

International Search Report received in PCT Application No. PCT/JP2021/015685 dated Jun. 22, 2021.

Extended European Search Report issued in the corresponding European Patent Application No. 25176957.6 on Sep. 1, 2025.

Office Action issued for corresponding Chinese Patent Application No. 202180096167.0 dated Mar. 17, 2026, w/ English Translation.

* cited by examiner

A-A

SHOE WITH KNITTED SHOE TONGUE

CROSS-REFERENCE TO RELATED APPLICATIONS

This application is the U.S. National Phase under 35 U.S.C. § 371 of International Patent Application No. PCT/JP2021/015685, filed on Apr. 16, 2021, the entire content of each of which is incorporated herein by reference.

BACKGROUND

1. Technical Field

The present disclosure relates to a shoe.

2. Description of the Related Art

Conventionally, the purposes of providing a shoe tongue in a shoe are mainly to cover the wearer's instep portion to prevent soil and dust from entering inside the shoe and also to protect the instep portion from tightening pressure from a shoelace (see Patent Literatures 1 and 2, for example).

PATENT LITERATURE

Patent Literature 1: Japanese Unexamined Patent Application Publication No. 2019-130370

Patent Literature 2: Japanese Patent No. 5950479

SUMMARY

Depending on the design for improvement in the fit of a shoe tongue to the instep, the shoe tongue may be drawn into the shoe due to friction with the instep when the foot is inserted, or the wearer's foot may feel tight when it is inserted.

The present disclosure has been made in view of such a problem, and a purpose thereof is to provide a shoe that achieves both the ease of foot insertion and the fit to a foot shape.

To solve the problem above, a shoe according to one aspect of the present disclosure includes a sole, an upper joined to the sole, and a shoe tongue provided in a space formed by the sole and the upper. The shoe tongue is formed of a knitted member and includes a ridge portion of inverted V shape along the front and rear directions of the shoe.

The "shoe" herein may be, for example, a type of shoe with a shoelace tightened and tied, such as a running shoe. The "upper" may be formed of a mesh member or a knitted member, for example. The "ridge portion" may have an inverted V shape folded to form a mountain-like shape prominent upward, in a middle part of the top surface of the shoe tongue along the front and rear directions. The inverted V portion may be sharply folded so that the fold is clearly recognized or may be folded in a curved shape so that the fold is indistinctive.

According to this aspect, since the shoe tongue is formed in an inverted V shape folded to form a mountain-like shape prominent upward, the opening for foot insertion can be made wider compared to the case of a conventional flat shoe tongue. Therefore, the area where friction between the shoe tongue and a foot occurs when the foot is inserted can be made smaller, making the shoe tongue less likely to get brought inside the shoe. Even with the inverted V shape, since the shoe tongue is formed of a flexible knitted member, it will be flat and fit the instep when a foot is inserted and the shoelace is tightened.

The shoe tongue may be formed of a single knitted member of sheet shape of which side ends on the medial side and the lateral side are each joined to the vicinity of a tangent between a bottom part and a side part in the space. The "being joined" may be, for example, being connected by means of sewing, bonding, vapor deposition, or the like. According to this aspect, since the both side ends of the shoe tongue are each joined to the vicinity of a tangent between the bottom part and a side part in the space, the shoe tongue can be made to fit the instep more easily such as to wrap around the entire midfoot portion.

In the shoe tongue, part of an area from the ridge portion to the side end on the medial side or the lateral side may be formed to have higher stretchability than at least part of other adjacent areas. According to this aspect, by providing highly stretchable regions from the ridge to the foot width directions, the shoe tongue can be made to fit to the foot width of each wearer more easily.

The shoe tongue may include a recess formed in an arc shape on part of a circumferential edge that continues from a tip part of the shoe tongue to each of the side ends on the medial side and the lateral side, and the arc degree of the arc forming the recess may be smaller than $\pi$ radian. According to this aspect, the ease of movement of the tip part can be ensured without deep cuts as provided in a conventional case. Only by providing a shallow recess formed by an arc with an arc degree of less than $\pi$ radian, the tip part can be moved more easily. Also, the area covering the instep becomes larger because there is no deep cut, and the fit to the instep can be improved.

In the shoe tongue, the tip part may be formed thicker than at least part of other adjacent portions. According to this aspect, the smoothness for a foot of the shoe tongue can be made favorable, and the feeling of tightness at the ankle can be reduced.

A thick portion of the tip part may be formed in a crescent shape in plan view, and each of the both ends of the crescent shape may extend toward the toe. Each of the both ends of the tip part may be located at a position overlapping and hidden by the upper and also overlapping an eyelet positioned closer to the ankle when the shoelace is tightened and tied, i.e., positioned at the uppermost end. According to this aspect, the eyelet (especially the metal eyelet) positioned at the uppermost end, with which the wearer often feels tightening of the shoelace, is less likely to come into direct contact with the instep, so that improved wearing comfort provided by protecting the instep can be expected.

DETAILED DESCRIPTION

Figure 1:
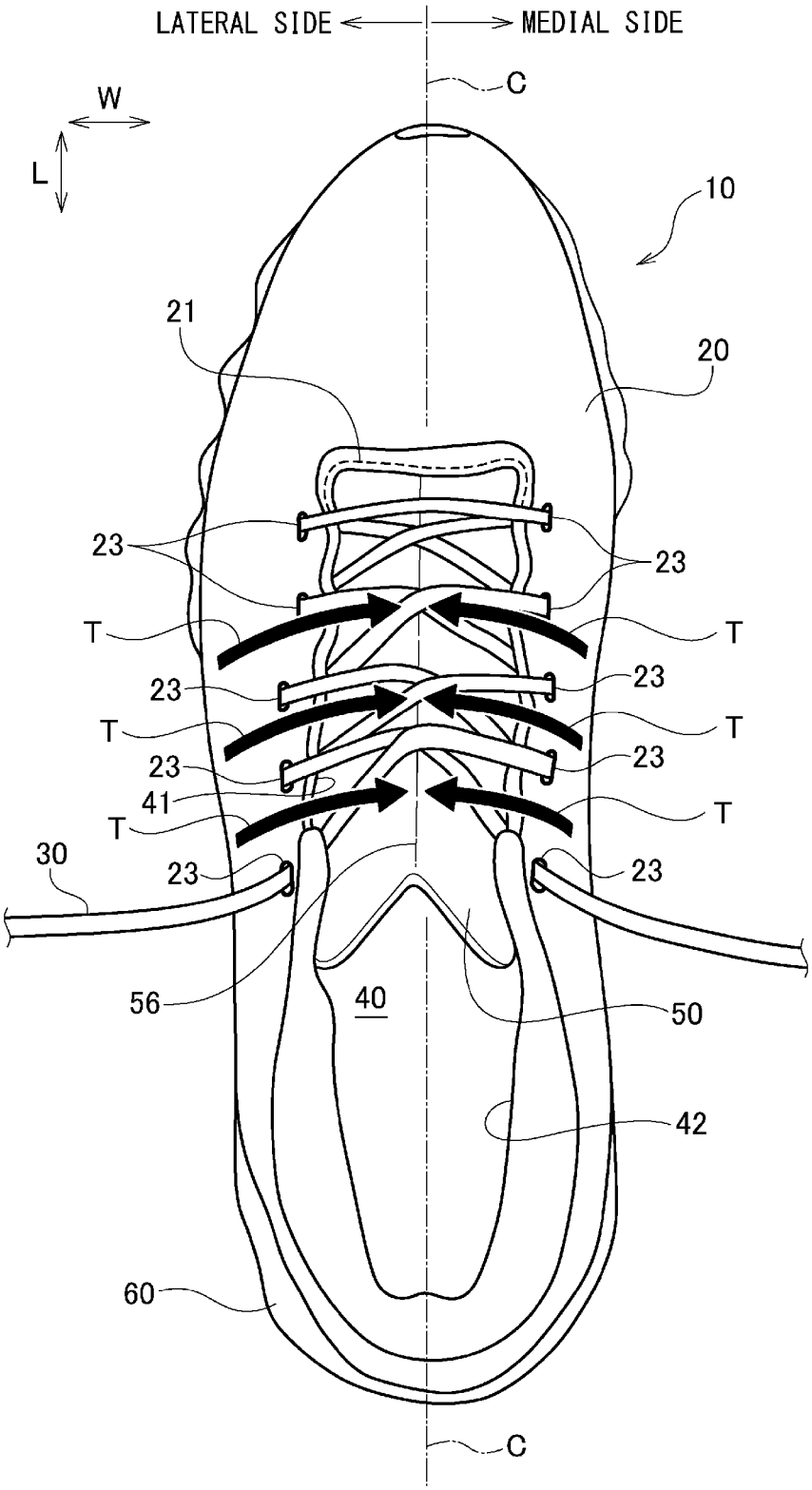
FIG. 1 is a schematic top view of a shoe according to a first embodiment.

The disclosure will now be described by reference to the preferred embodiments. This does not intend to limit the scope of the present invention, but to exemplify the invention.

In the following, the present disclosure will be described based on preferred embodiments with reference to each drawing. In the embodiments and modifications, like reference characters denote like or corresponding constituting elements and members, and the repetitive description will be omitted as appropriate. Also, the dimensions of a member may be appropriately enlarged or reduced in each drawing in order to facilitate understanding. In each drawing, part of a member less important in describing embodiments may be omitted.

First Embodiment

FIG. 1 is a schematic top view of a shoe according to the first embodiment. In the following, a configuration of a shoe 10 according to the present embodiment will be described with reference to the drawings. Each drawing mentioned below, including FIG. 1, illustrates a shoe and components thereof for a left foot, unless otherwise specified. However, the description in the present specification is also similarly applicable to a shoe and components thereof for a right foot.

The shoe 10 of the present embodiment is a laced shoe used for sports such as running or walking. The shoe includes an upper 20, a shoelace 30, a shoe tongue 50, and a sole 60. The right side of a center line C with respect to a foot width direction of the shoe 10 in FIG. 1 is referred to as a "medial side", and the left side of the center line C in FIG. 1 is referred to as a "lateral side". In the case of a right-foot shoe, the medial side and the lateral side are reversed from left to right. The arrow W pointing to the left and right in FIG. 1 indicates foot width directions, and the arrow L pointing upward and downward in FIG. 1 indicates the front and rear directions of the shoe 10.

The upper 20 is joined, at its hem, to the sole 60 to form an internal space 40 for accommodating a wearer's foot. Also, an instep opening 41 is formed at a position corresponding to the wearer's instep in an upper front part of the shoe 10, and a foot insertion opening 42, into which the wearer inserts the foot, is formed in an upper rear part of the shoe 10. When the wearer puts the shoe 10 on, the upper 20 wraps the entire top portion of the foot. The upper 20 and the sole 60 are joined together by means of bonding or the like.

The shoe tongue 50 is provided such as to close the instep opening 41 from the inner side of the upper 20, i.e., from the internal space 40 side, and covers an area from a front part of the ankle to the instep of the wearer. The shoe tongue 50 is a component independent of the upper 20, and an end part of the shoe tongue 50 is sewn to an opening end 21 of the upper 20, which forms the front end of the instep opening 41. A tip part of the shoe tongue 50 comes into contact with the front of the ankle when the foot is inserted.

The shoelace 30 is made to pass through multiple eyelets 23 and intersect on the shoe tongue 50. When the shoelace 30 is tightened, downward pressing force caused by the tightening force is applied to the wearer's instep via the shoe tongue 50, so that the shoe tongue 50 fits the wearer's instep. Although FIG. 1 illustrates a type of shoe that is tightened with the shoelace 30 passed through the eyelets 23, it may also be a type of shoe that is tightened by hooking the shoelace 30 onto hooks, a type of shoe that is tightened with a dial-type shoelace, or a type of shoe that is tightened with a hook-and-loop fastener.

The shoe tongue 50 is formed as a single knitted member by interweaving multiple types of knitting yarns having different properties, such as the material and thickness. The shoe tongue 50 includes a ridge portion 56 extending along front and rear directions L at a substantially middle position in top view, i.e., at a position almost along the center line C. The ridge portion 56 has an inverted V shape folded to form a mountain-like shape prominent upward, and the shoe tongue 50 is formed with an interweaving method to have a three-dimensional shape such that such an inverted V shape remains in the middle. The inverted V shape of the ridge portion 56 may be made by sharp folding so that the fold is clearly recognized or may be a curved shape such that the fold is indistinctive.

When the shoelace 30 is tightened, tightening force is generated from both the medial side and the lateral side toward the center line C, as indicated by tightening directions T in FIG. 1. The tightening force then becomes downward pressing force and is applied to the top surface of the shoe tongue 50, so that the shoe tongue 50 is pressed against the instep. Also, the shoe tongue 50 is a component independent of the upper 20, and, as will be described later, both side ends of the shoe tongue 50 are sewn to an inner sole of the sole 60 in the internal space 40, so as to be pulled in foot width directions W; with the stretchability and flexibility of the knitted member, the shoe tongue 50 fits the entire instep side of the wearer's midfoot portion. In the case of a conventional integral structure in which the upper 20 and the shoe tongue 50 are integrally formed, when the shoelace is tightened, there is no place for the upper or the shoe tongue to escape under the shoe lace, which may cause wrinkling of the upper or shoe tongue on the instep. In contrast, the shoe tongue 50 of the present embodiment is joined, at its side ends extending toward the medial side and the lateral side, to the inner sole and can spread in the foot width directions, thereby preventing deformation such that the shoe tongue 50 is pulled and gathered toward the vicinity of the center line C when the shoelace 30 is tightened.

Figure 2:
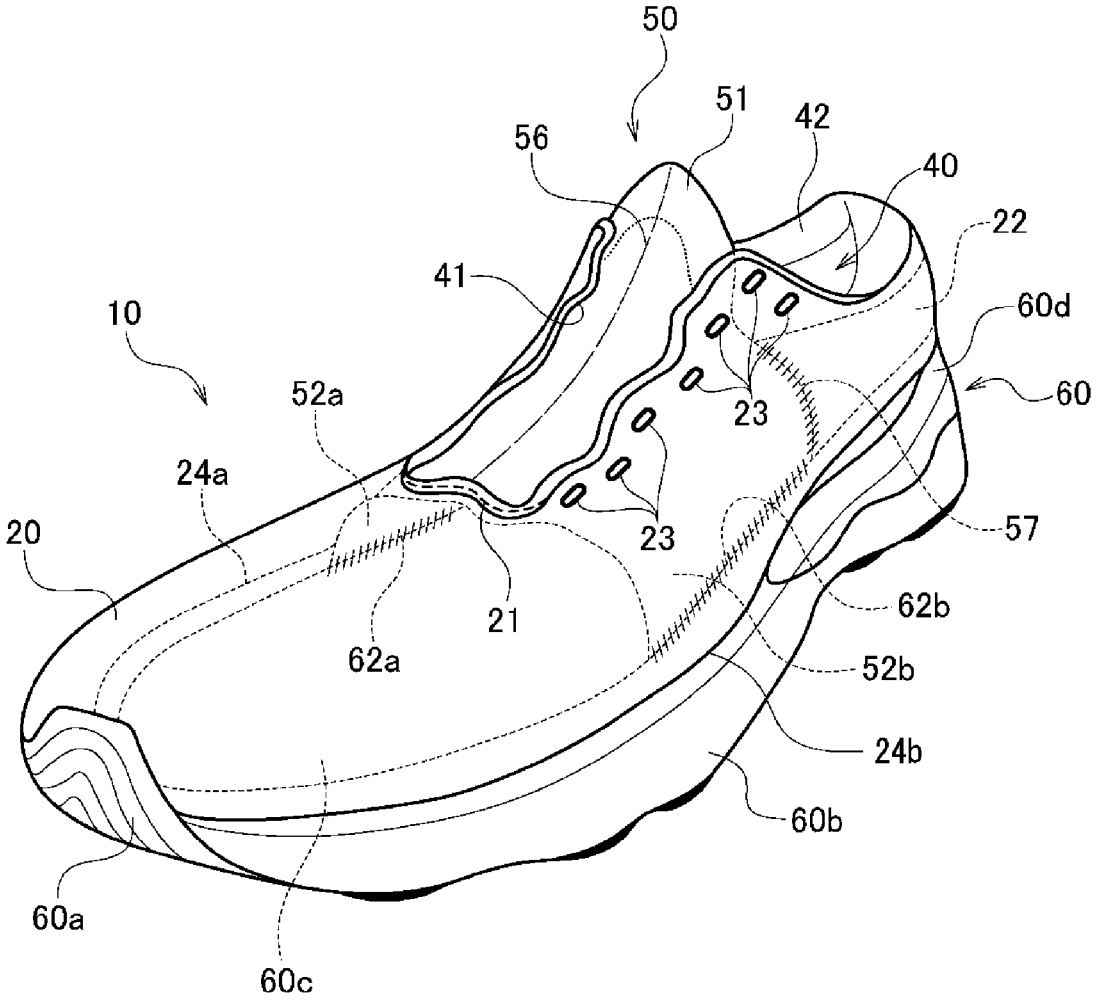
FIG. 2 is a perspective view of the shoe viewed obliquely from a front left side.

FIG. 2 is a perspective view of the shoe viewed obliquely from a front left side. FIG. 2 illustrates the state where the shoelace 30 is removed. The sole 60 is configured such that a midsole 60*b* and an inner sole 60*c* are overlaid in this order and bonded onto an outsole 60*a*, which is a portion to be in contact with the ground, and a heel counter 60*d* is also bonded at the position of the heel. Since the inner sole 60*c* is provided inside the upper 20 and invisible from the outside, it is indicated by dotted lines in the drawing. The shoe tongue 50 is indicated by solid lines for the portion exposed through the instep opening 41 and by dotted lines for the portions hidden by the upper 20. The top surface contour of the midsole 60*b* is also indicated by dotted lines for the medial side portion hidden by the upper 20. In an actual product, a sock liner, not illustrated, is inserted into the internal space 40 and laid on the bottom, i.e., on the inner sole 60*c*.

The shoe tongue 50 forms an inverted V shape in the ridge portion 56 located in the middle on the top surface. In a state where a foot is not inserted into the shoe 10, the inverted V shape of the ridge portion 56 is formed such that it warps along a direction from the toe to a tip part 51, as illustrated. This naturally facilitates widening of the foot insertion opening 42 and also facilitates the wearer's foot insertion into the foot insertion opening 42. The tip part 51 is formed thicker than other adjacent portions in the shoe tongue 50.

A medial side end of the upper 20 and the sole 60 are joined at a medial side tangent 24*a*, and a lateral side end of the upper 20 and the sole 60 are joined at a lateral side tangent 24*b*. A medial side end 52*a* of the shoe tongue 50 is sewn to the upper 20 near the medial side tangent 24*a*, and a lateral side end 52*b* of the shoe tongue 50 is sewn to the upper 20 near the lateral side tangent 24*b*. The outline of the inner sole 60*c* is one size smaller than the outline of the midsole 60*b*, and a dotted line indicating the outline of the inner sole 60*c* is drawn inside the medial side tangent 24*a* and the lateral side tangent 24*b*. The medial side end 52*a* of the shoe tongue 50 is sewn to the inner sole 60*c* at the position of a medial side tangent 62*a* along the outline of the inner sole 60*c*, and the lateral side end 52*b* of the shoe tongue 50 is sewn to the inner sole 60*c* at the position of a lateral side tangent 62*b* along the outline of the inner sole 60*c*.

The tip part 51 is formed in a crescent shape with both ends extending downward. Each of the both ends extending downward of the tip part 51 is located at a position overlapping and hidden by the upper 20 and also overlaps an eyelet 23 positioned closer to the ankle when the shoelace 30 is tightened and tied, i.e., positioned at the uppermost end. Accordingly, the eyelet 23 (especially the metal eyelet) positioned at the uppermost end, with which the wearer often feels tightening of the shoelace 30, is less likely to come into direct contact with the instep, so that improved wearing comfort provided by protecting the instep can be expected.

As a modification, the medial side end 52*a* and the lateral side end 52*b* may be joined to the sole 60 by means of bonding or the like, instead of sewing. Also, as another modification, the medial side end 52*a* and the lateral side end 52*b* may be joined to the upper 20, instead of the sole 60, near the tangent between the sole 60 and the upper 20.

The end part of the shoe tongue 50, located at the front, is sewn to the opening end 21 of the upper 20, which forms the instep opening 41. An outer edge portion 57 adjacent to the lateral side end 52*b* of the shoe tongue 50 is sewn to an inner fabric 22, which is a mesh member, near the foot insertion opening 42, and the shoe tongue 50 and the inner fabric 22 integrally form an inner wall of the internal space 40 near the opening end 21.

Figure 3:
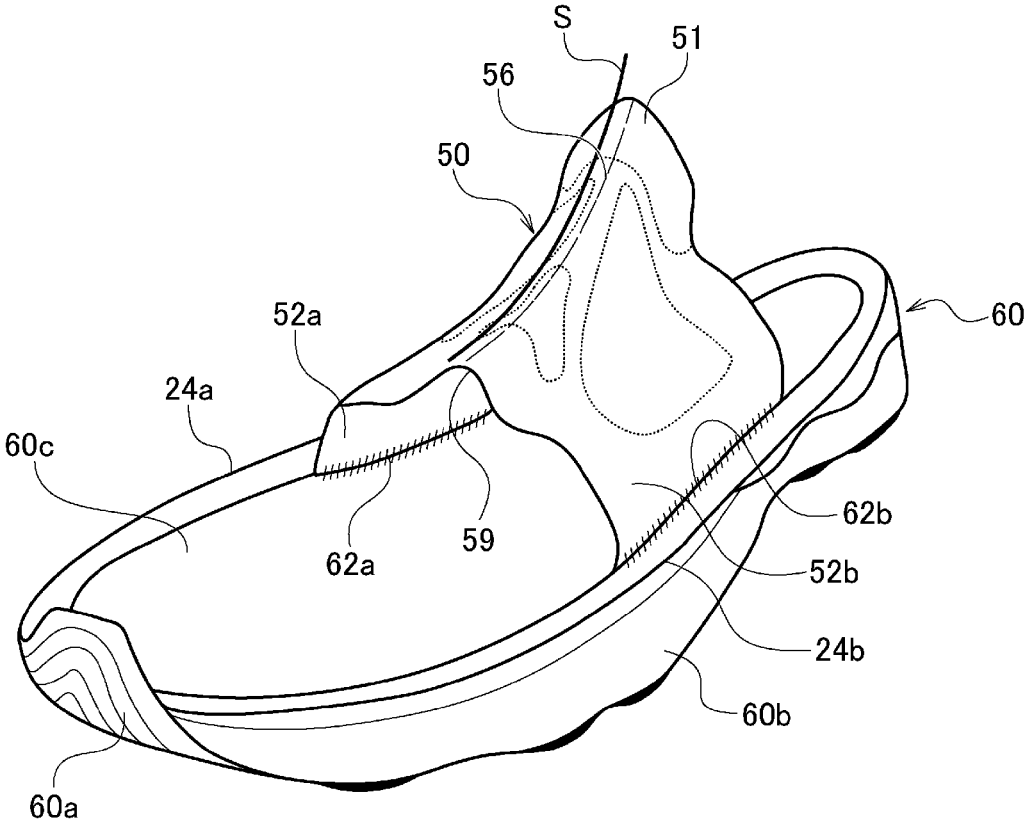
FIG. 3 is a perspective view that shows a joint state of a sole and a shoe tongue.

FIG. 3 is a perspective view that shows a joint state of the sole 60 and the shoe tongue 50. FIG. 3 illustrates the state where the upper 20, shoelace 30, and heel counter 60*d* are removed. The medial side tangent 24*a* and the lateral side tangent 24*b* almost coincide with the top surface contour of the midsole 60*b*. On the top surface of the midsole 60*b*, the inner sole 60*c* is bonded slightly inside the medial side tangent 24*a* and the lateral side tangent 24*b*, forming a bottom part of the internal space 40 formed by the upper 20. Although not illustrated, the hem of the upper 20 is bonded along the top surface contour of the midsole 60*b* such as to be sandwiched between the outer circumference of the lower surface of the inner sole 60*c* and the midsole 60*b*. Also, together with the medial side end 52*a* and the lateral side end 52*b*, the hem of the upper 20 is sewn to the inner sole 60*c*, along the top surface contour of the inner sole 60*c*. In FIG. 3, the medial side tangent 62*a* where the medial side end 52*a* and the inner sole 60*c* are sewn together and the lateral side tangent 62*b* where the lateral side end 52*b* and the inner sole 60*c* are sewn together are indicated by diagonal lines. In actuality, together with the hem of the upper 20, not illustrated, the medial side end 52*a* and the lateral side end 52*b* are sewn to the inner sole 60*c*.

In a state where a foot is not inserted into the shoe 10, the inverted V shape of the ridge portion 56 is formed such that it warps upward from an end part 59 on the front side (toe side) to the tip part 51, as indicated by a highlighted line S. This naturally facilitates widening of the foot insertion opening 42 and also facilitates the wearer's foot insertion into the foot insertion opening 42.

The shoe tongue 50 is a component independent of the upper 20 and woven to have a three-dimensional shape that fits the instep by itself. With the medial side end 52*a* and the lateral side end 52*b* joined to the sole 60, the shoe tongue 50 independently extends upward. Also, since the shoe tongue 50, which is a knitted member with high stretchability, wraps around not only the instep but also the entire midfoot portion, the fit of the shoe tongue 50 to the midfoot portion can be enhanced. Also, since the ridge portion 56 has a shape such that it warps along a direction from the toe to the tip part 51, the foot insertion opening 42 can be widened easily. This reduces the possibility of the shoe tongue 50 being brought inside the shoe 10 due to friction with the foot when the wearer inserts the foot, thereby facilitating the foot insertion. Further, since the shoe tongue 50 extends upward, the pressing force applied to the wearer's instep can be reduced. Since the three-dimensional shape is provided at the manufacturing stage of the shoe tongue 50, the ridge portion can be made free from seams, which would be unavoidable if the three-dimensional shape were provided in secondary processing, so that the smoothness for a foot can be made favorable. In addition, the disadvantages of providing the three-dimensional shape in secondary processing, such as complicated manufacturing processes and loss of materials due to cutting, can be avoided in the present embodiment.

Figure 4:
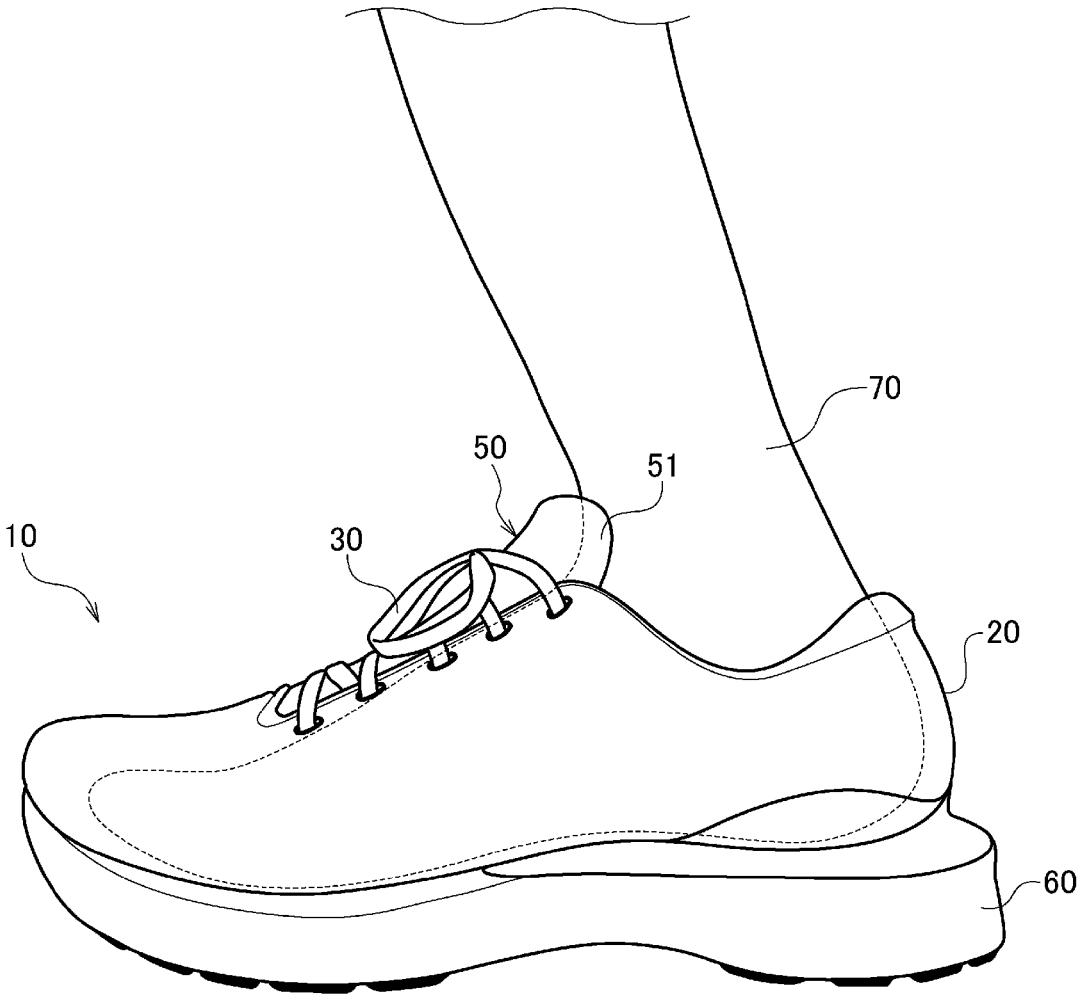
FIG. 4 is a side view that shows a state where the wearer has inserted the foot into the shoe.

FIG. 4 is a side view that shows a state where the wearer has inserted the foot into the shoe. When the wearer bends the joint of an ankle 70 forward, i.e., bends the ankle joint such that the angle between the ankle and the instep becomes smaller, the front surface of the ankle 70 touches the inner surface of the tip part 51 of the shoe tongue 50. At the time, depending on the material, shape, and hardness of the shoe tongue 50, the wearer may feel strong tightening at the ankle. Since the tip part 51 of the present embodiment is formed thicker than other adjacent portions in the shoe tongue 50, the smoothness for a foot of the shoe tongue 50 can be made favorable. Also, the stretchability and elasticity of the shoe tongue 50 can reduce the feeling of tightness at the ankle.

Figure 5:
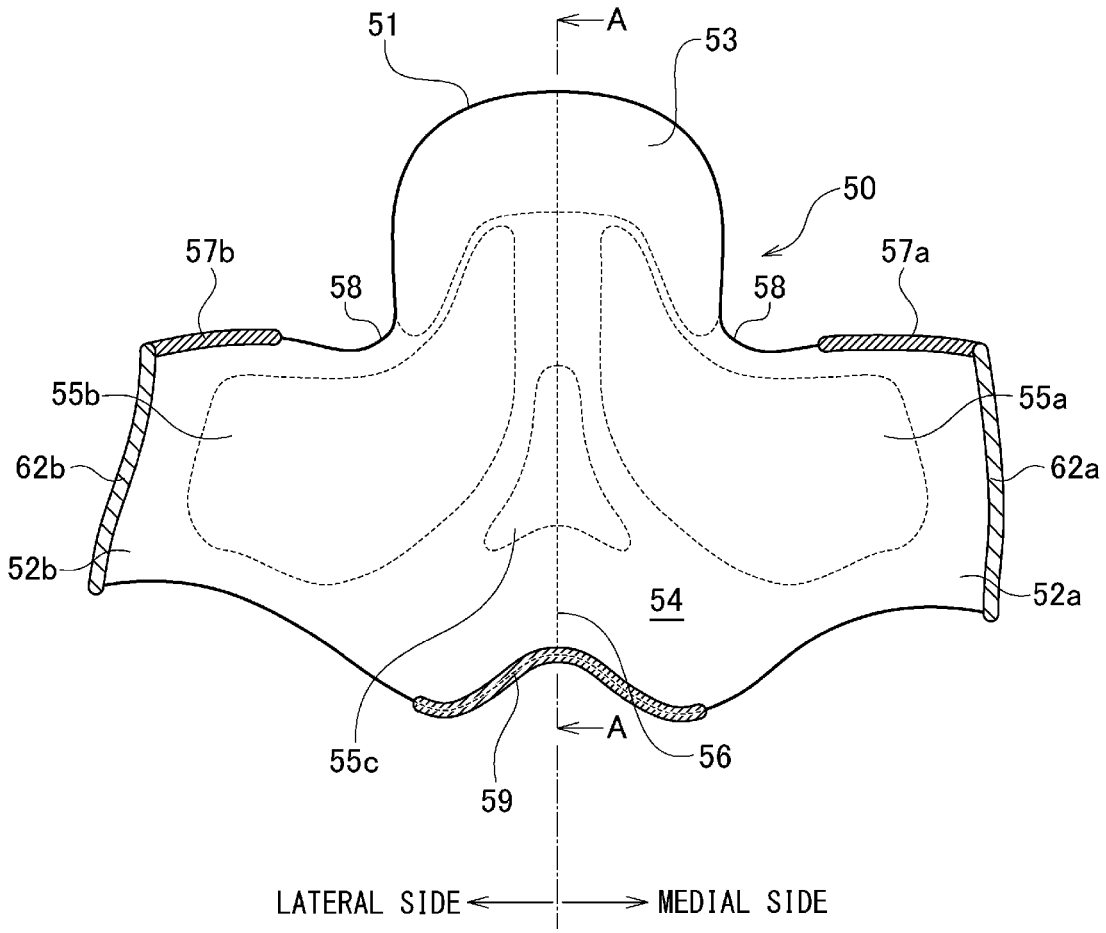
FIG. 5 is a bottom view of the shoe tongue in a spread state in the first embodiment.

FIG. 5 is a bottom view of the shoe tongue 50 in a spread state in the first embodiment. The shoe tongue 50 of the present embodiment is configured to include the tip part 51 extending upward in FIG. 5 in an upper semicircular shape, the medial side end 52*a* extending toward the medial side in a quadrangular shape, the lateral side end 52*b* extending toward the lateral side in a quadrangular shape, the end part 59 extending downward in FIG. 5 in a wavy shape, and a portion near the ridge portion 56. The medial side end 52*a* is sewn to the inner sole 60*c* at the medial side tangent 62*a*, and the lateral side end 52*b* is sewn to the inner sole 60*c* at the lateral side tangent 62*b*. The end part 59 is sewn to the upper 20 at the opening end 21. An outer edge portion 57*a*, which is the top side of the medial side end 52*a* adjacent to the medial side tangent 62*a*, and an outer edge portion 57*b*, which is the top side of the lateral side end 52*b* adjacent to the lateral side tangent 62*b*, are sewn to the inner fabric 22 in the internal space 40.

With the shoe tongue 50 of the present embodiment, multiple regions having different stretchability and different thicknesses can be integrally formed in a single shoe tongue 50, by changing the materials and thicknesses of knitting yarns, the knitting method, and the like used for each region. In the shoe tongue 50 of the present embodiment, multiple regions of a high stretch region, a medium stretch region, and a low stretch region divided based on the stretchability are integrally formed. Also, by changing the knitting method depending on the area, an inverted V shape forming a mountain-like shape is made along the center line.

In the tip part 51 of the shoe tongue 50, a low stretch region 53 having a crescent shape in plan view is formed. The crescent shape of the low stretch region 53 is an upper semicircular shape of which the left and right ends extend such as to hang downward in FIG. 5, i.e., in the direction toward the toe. The low stretch region 53 is formed by weaving a knitting yarn of synthetic fiber having low stretchability. The low stretch region 53 is woven thicker and tighter with a low-stretch knitting yarn such as to be thicker than other adjacent portions.

As high stretch regions 55, a central high stretch region 55*c* of triangular shape, which is long in the front and rear directions, is provided to extend downward from the vicinity of the center of the shoe tongue 50 along the ridge portion 56, and a medial side high stretch region 55*a* and a lateral side high stretch region 55*b* are also provided respectively on both sides of the central high stretch region 55*c* to extend on the medial side and the lateral side. The medial side high stretch region 55*a* is disposed on the medial side of the ridge portion 56 and has a shape extending, from a position between the lower right end of the low stretch region 53 and the ridge portion 56, downward to the right and then toward the medial side in a width direction. Also, the lateral side high stretch region 55*b* is disposed on the lateral side of the ridge portion 56 and has a shape extending, from a position between the lower left end of the low stretch region 53 and the ridge portion 56, downward to the left and then toward the lateral side in a width direction.

The high stretch regions 55 are formed to have higher stretchability than adjacent surrounding regions. Each high stretch region 55 is formed by weaving a knitting yarn of polyurethane elastic fiber (so-called spandex), for example, as a knitting yarn having high stretchability. A suitable thickness of spandex used for the high stretch regions 55 may be, for example, 100 to 350 denier. Each high stretch region 55 is woven with coarse density so as to be thinner than the low stretch region 53.

In the shoe tongue 50, the region excluding the low stretch region 53 and the high stretch regions 55 is a medium stretch region 54. The medium stretch region 54 is more stretchable than the low stretch region 53 and less stretchable than the high stretch regions 55. The medium stretch region 54 may be formed by weaving a spandex knitting yarn thinner than that used for a high stretch region 55. Even with the same spandex, thinner spandex has relatively lower stretchability and, especially, the contractile force is relatively weak. The medium stretch region 54 is woven with density such that the region has a thickness intermediate between the thicknesses of a high stretch region 55 and the low stretch region 53.

By making the low stretch region 53 in a crescent shape with a recess in the lower part, a large portion of the ridge portion 56, including the vicinity of the tip part 51, can be made stretchable and thinner than the low stretch region 53, so that the three-dimensional shape can be maintained more easily. Also, by providing highly stretchable regions from the ridge portion 56 to the foot width directions, the shoe tongue can be made to fit to the foot width different for each wearer more easily.

The shoe tongue 50 has a recess 58 formed in an arc shape on part of a circumferential edge that continues from the tip part 51 to each of the side ends on the medial side and the lateral side. The arc degree of the arc forming each recess 58 is smaller than n rad. In the case of a conventional shoe tongue formed of a material with low stretchability, a deep cut needs to be provided at a position corresponding to each recess 58 of the present embodiment so that the tip part can be pulled and moved more easily. Also, in the case of a shoe tongue with such a shape, the fit to the instep may be reduced because of the deep cuts. In contrast, since the shoe tongue 50 of the present embodiment is formed of a knitted member with excellent stretchability, the ease of movement of the tip part 51 can be ensured without the deep cuts provided in the conventional case. Also, each recess 58 has a relatively large radius of curvature, and a shallow recess formed by an arc with an arc degree of less than n rad will suffice. In this case, the area covering the instep becomes larger because there is no deep cut, and the fit to the instep can be improved.

Figure 6:
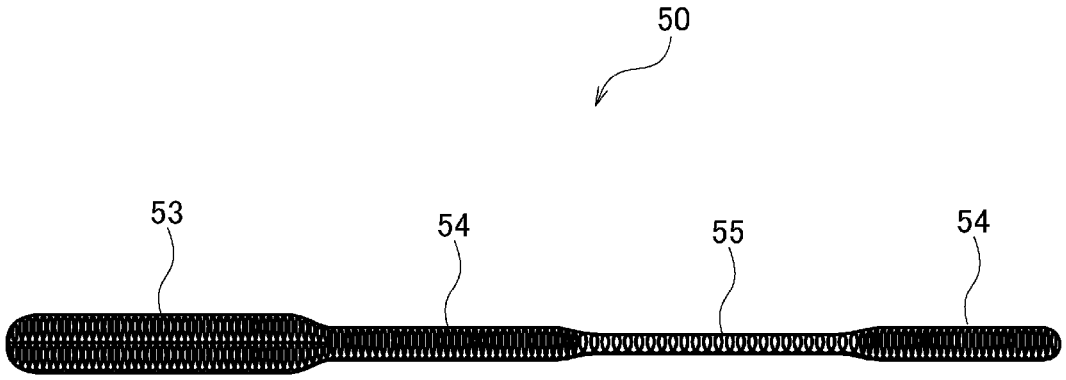
FIG. 6 is a schematic diagram of a cross section of the shoe tongue taken along line A-A in FIG. 5.

FIG. 6 schematically illustrates a cross section of the shoe tongue taken along line A-A in FIG. 5. The shoe tongue 50 is a knitted member of which the surface is formed by continuous loops made by continuously hooking, onto a minute loop of a knitting yarn, the subsequent loop of the knitting yarn. From the left in FIG. 6, the low stretch region 53, the medium stretch region 54, a high stretch region 55, and the medium stretch region 54 are shown. The low stretch region 53 is formed by tight weaving so as to be thicker than other regions, using a knitting yarn having lower stretchability than the knitting yarns for other regions. In a conventional shoe tongue using a knitted material, multiple layers, such as two layers, are overlapped in a portion to be particularly thickened, and a cavity may be sometimes formed between the multiple layers. In contrast, in the present embodiment, even the thick portion of the low stretch region 53 is woven as a single knitted member, instead of being formed by multiple layers between which a cavity could occur.

Each high stretch region 55 is formed by weaving a spandex knitting yarn having high stretchability. Each high stretch region 55 is woven with coarse density so as to be thinner than the low stretch region 53. The medium stretch region 54 is formed more stretchable than the low stretch region 53 and less stretchable than the high stretch regions 55. The medium stretch region 54 may be formed by weaving a spandex knitting yarn thinner than that used for a high stretch region 55. The medium stretch region 54 is woven with density such that the region has a thickness intermediate between the thicknesses of a high stretch region 55 and the low stretch region 53.

In this way, by continuously weaving the low stretch region 53, medium stretch region 54, and high stretch regions 55 so that they have different thicknesses using knitting yarns of different materials and thicknesses, the multiple regions are integrally formed into a single knitted member.

Second Embodiment

The present embodiment differs from the first embodiment in the arrangement of stretch regions in the shoe tongue 50. In the following, description will be given mainly for the differences from the first embodiment, and the explanation of features in common will be omitted. As described in the second through nineteenth embodiments below, by changing the shapes and arrangement of the stretch regions included in the shoe tongue, a shoe tongue with different functions can be realized by a single shoe tongue.

Figure 7:
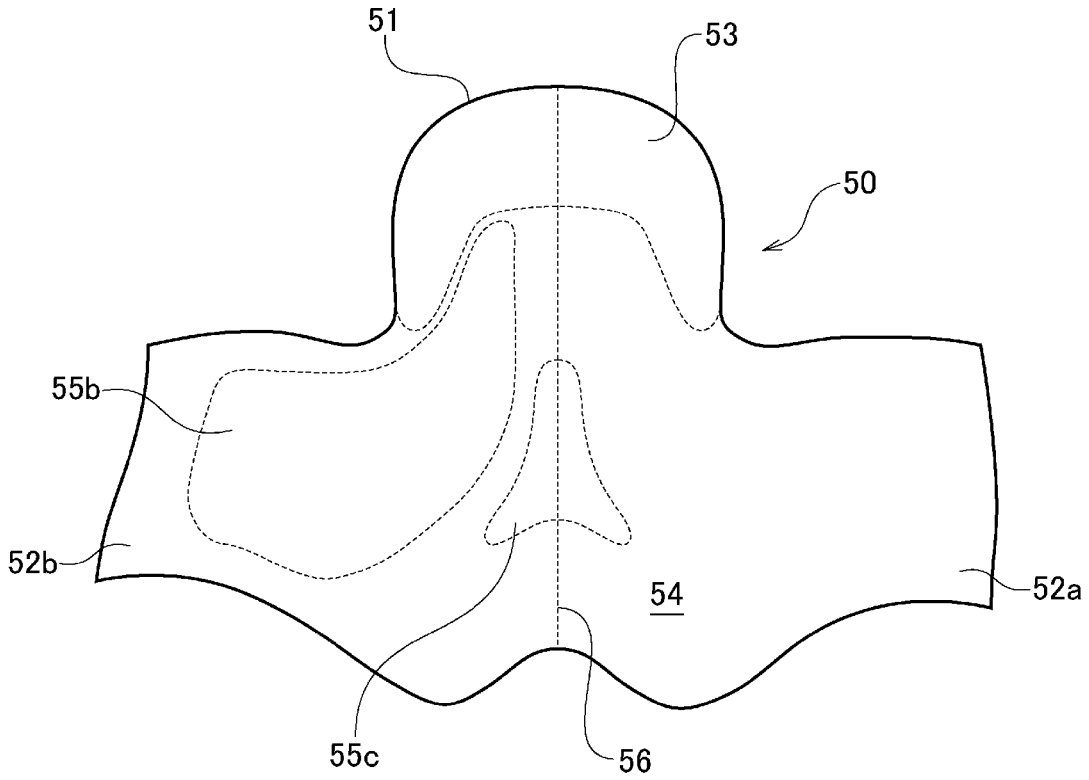
FIG. 7 is a bottom view of the shoe tongue in a spread state in a second embodiment.

FIG. 7 is a bottom view of the shoe tongue 50 in a spread state in the second embodiment. The present embodiment differs from the first embodiment in that the medial side high stretch region is not provided on the medial side (the right side in FIG. 7). The position where the medial side high stretch region 55*a* is provided in the first embodiment corresponds to part of the medium stretch region 54 in the present embodiment, which has lower stretchability than the lateral side high stretch region 55*b* located in the symmetrical position. This can make the medial side less stretchable and more rigid than the lateral side, thereby preventing excessive pronation due to collapse of the arch.

Third Embodiment

The present embodiment differs from the first embodiment in the shape of a stretch region in the shoe tongue 50. In the following, description will be given mainly for the differences from the first embodiment, and the explanation of features in common will be omitted.

Figure 8:
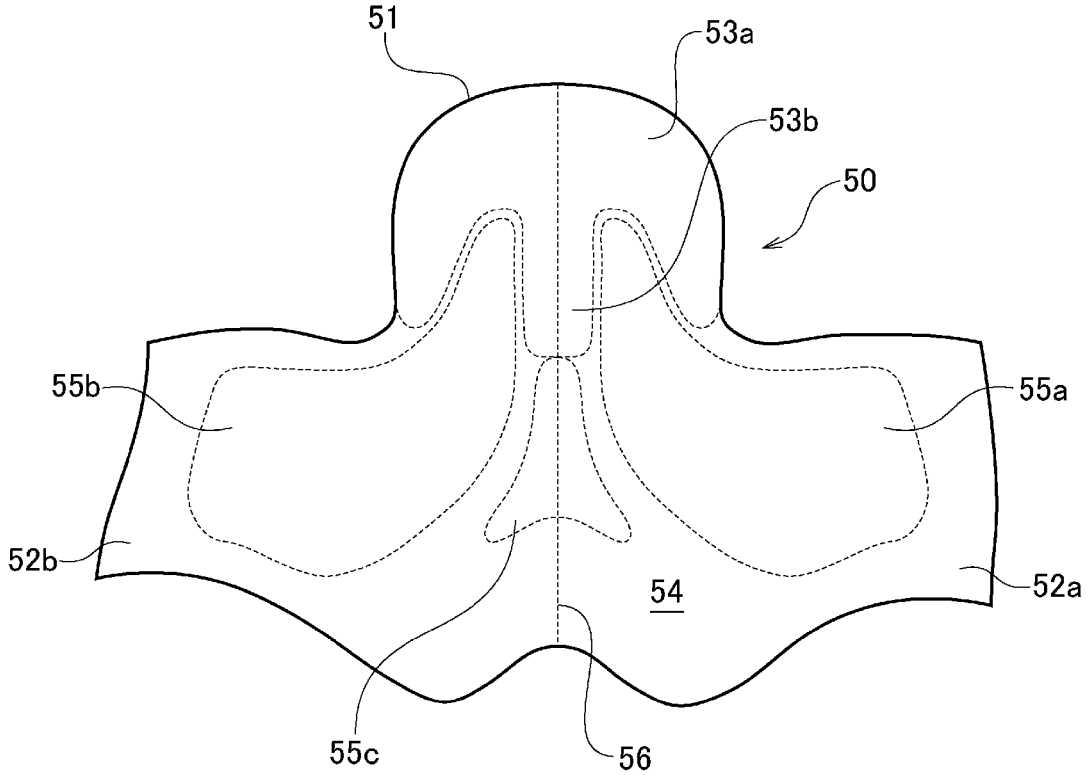
FIG. 8 is a bottom view of the shoe tongue in a spread state in a third embodiment.

FIG. 8 is a bottom view of the shoe tongue 50 in a spread state in the third embodiment. The shape of the low stretch region 53 in the tip part 51 is different from that of the first embodiment. More specifically, the present embodiment differs from the first embodiment in that, while the low stretch region 53 of the first embodiment is crescent-shaped, the low stretch region 53 of the third embodiment includes a central downward extending portion 53*b* that extends downward from a center part of a crescent-shaped portion 53*a* to the upper end of the central high stretch region 55*c* along the ridge portion 56, so that the low stretch region 53 has an overall shape similar to a T-shape. This can increase the thick area along the ridge portion 56, thereby further reducing the feeling of tightness on the instep when the shoelace 30 is tightened.

Fourth Embodiment

The present embodiment differs from the third embodiment in the arrangement of stretch regions in the shoe tongue 50. In the following, description will be given mainly for the differences from the third embodiment, and the explanation of features in common will be omitted.

Figure 9:
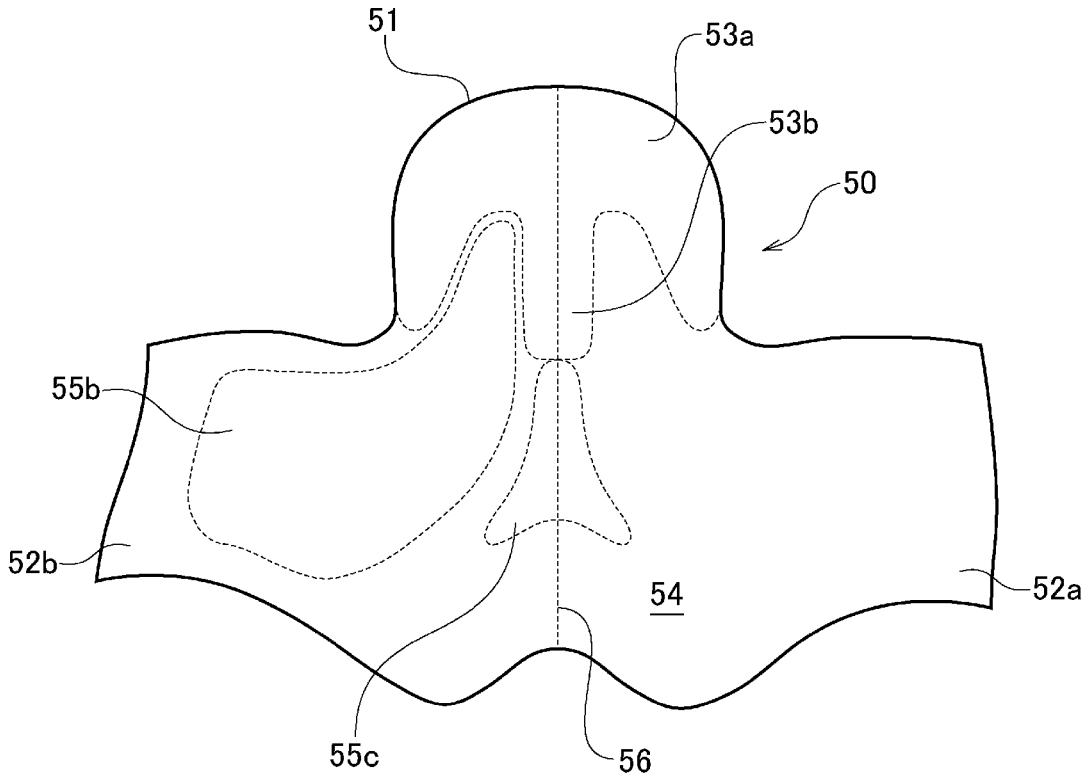
FIG. 9 is a bottom view of the shoe tongue in a spread state in a fourth embodiment.

FIG. 9 is a bottom view of the shoe tongue 50 in a spread state in the fourth embodiment. The present embodiment differs from the third embodiment in that the medial side high stretch region is not provided on the medial side (the right side in FIG. 9). The position where the medial side high stretch region 55*a* is provided in the third embodiment corresponds to part of the medium stretch region 54 in the present embodiment, which has lower stretchability than the lateral side high stretch region 55*b* located in the symmetrical position. This can make the medial side less stretchable and more rigid than the lateral side, thereby preventing excessive pronation due to collapse of the arch.

Fifth Embodiment

The present embodiment differs from the first embodiment in the shapes and arrangement of stretch regions in the shoe tongue 50. In the following, description will be given mainly for the differences from the first embodiment, and the explanation of features in common will be omitted.

Figure 10:
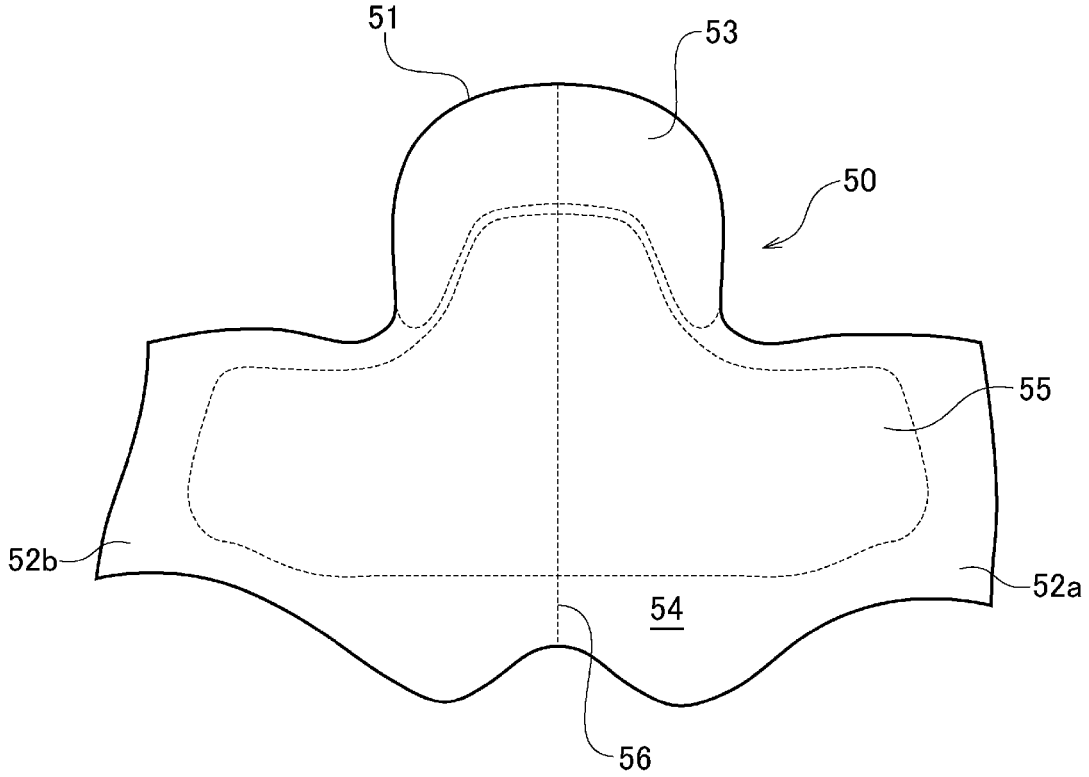
FIG. 10 is a bottom view of the shoe tongue in a spread state in a fifth embodiment.

FIG. 10 is a bottom view of the shoe tongue 50 in a spread state in the fifth embodiment. The high stretch region 55 of the present embodiment is not divided into multiple regions and has the size, position, and shape such that it covers all of the medial side high stretch region 55*a*, the lateral side high stretch region 55*b*, and the central high stretch region 55*c* in the first embodiment. This can achieve stretchability equal to or higher than that in the first embodiment and can also provide the same effect as the first embodiment.

The low stretch region 53 in the present embodiment has a crescent shape as in the first embodiment. The low stretch region 53 in a modification may have a shape similar to a T-shape formed such that a center part of a crescent shape extends downward along the ridge portion 56 to the vicinity of the center of the shoe tongue 50, as with the low stretch region 53 in the third and fourth embodiments. In each of the following embodiments, when the low stretch region 53 of crescent shape is described as an example, the low stretch region 53 of T-shape may also be used as a modification. Also, when the low stretch region 53 of T-shape is described as an example, the low stretch region 53 of crescent shape may also be used as a modification.

Sixth Embodiment

The present embodiment differs from the fifth embodiment in the shapes and arrangement of stretch regions in the shoe tongue 50. In the following, description will be given mainly for the differences from the fifth embodiment, and the explanation of features in common will be omitted.

Figure 11:
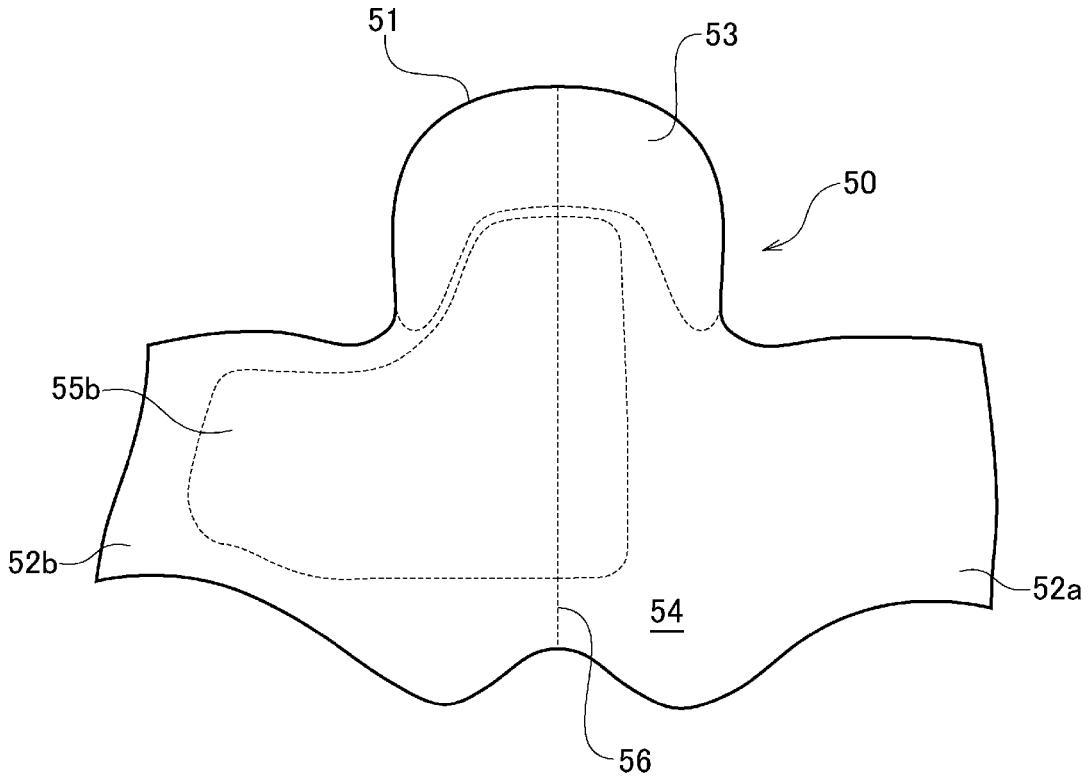
FIG. 11 is a bottom view of the shoe tongue in a spread state in a sixth embodiment.

FIG. 11 is a bottom view of the shoe tongue 50 in a spread state in the sixth embodiment. The present embodiment differs from the fifth embodiment in that no high stretch region is provided on the medial side (the right side in FIG. 11). More specifically, the high stretch region 55 of the present embodiment has a shape such that a medial side area is removed from the high stretch region 55 in the fifth embodiment and covers a lateral side area and a center area along the ridge portion 56. The medial side area in the present embodiment is part of the medium stretch region 54 and has lower stretchability than the lateral side area and the center area. This can make the medial side less stretchable and more rigid than the lateral side and the center area, thereby preventing excessive pronation due to collapse of the arch.

Seventh Embodiment

The present embodiment differs from the first embodiment in the shapes and arrangement of stretch regions in the shoe tongue 50. In the following, description will be given mainly for the differences from the first embodiment, and the explanation of features in common will be omitted.

Figure 12:
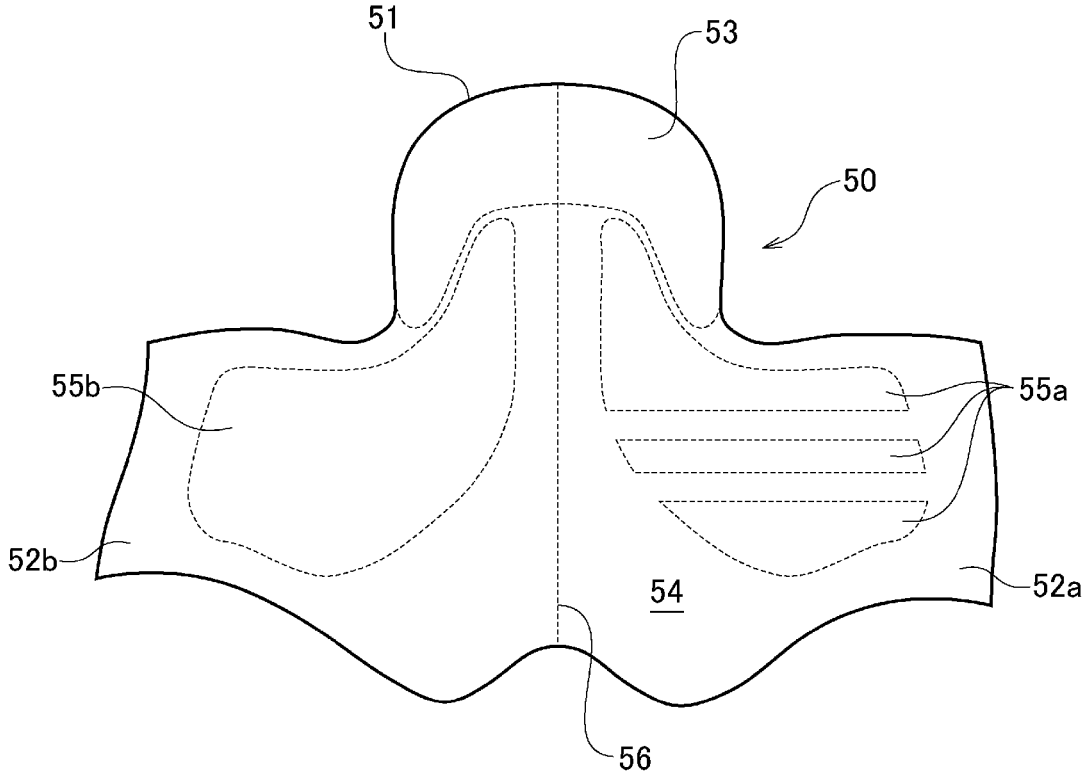
FIG. 12 is a bottom view of the shoe tongue in a spread state in a seventh embodiment.

FIG. 12 is a bottom view of the shoe tongue 50 in a spread state in the seventh embodiment. The medial side high stretch region 55*a* of the present embodiment is divided into multiple regions and differs in shape from the medial side high stretch region 55*a* of the first embodiment. More specifically, the medial side high stretch region 55*a* of the present embodiment has an overall contour that almost coincides with that of the medial side high stretch region 55*a* of the first embodiment, is formed in almost the same area, but has a shape divided into multiple parts by multiple band-shaped slits provided along the left and right directions at positions corresponding to the midfoot portion of the wearer. Each slit portion is part of the medium stretch region 54 and has lower stretchability than the medial side high stretch region 55*a*. On the medial side as a whole, the stretchability is higher compared to a configuration in which no high stretch region is provided on the entire medial side surface, as in the second and fourth embodiments; however, compared to the lateral side on which the lateral side high stretch region 55*b* is provided, the stretchability is slightly lower in the midfoot portion. Further, a center portion along the ridge portion 56 is also not provided with a high stretch region. This can strengthen the tightening in the midfoot portion and prevent excessive pronation due to collapse of the arch.

In the present embodiment, the center portion along the ridge portion 56 is not provided with a high stretch region but may be provided, in a modification, with a central high stretch region similar to that in the first embodiment.

Eighth Embodiment

The present embodiment differs from the seventh embodiment in the shapes and arrangement of stretch regions in the shoe tongue 50. In the following, description will be given mainly for the differences from the seventh embodiment, and the explanation of features in common will be omitted.

Figure 13:
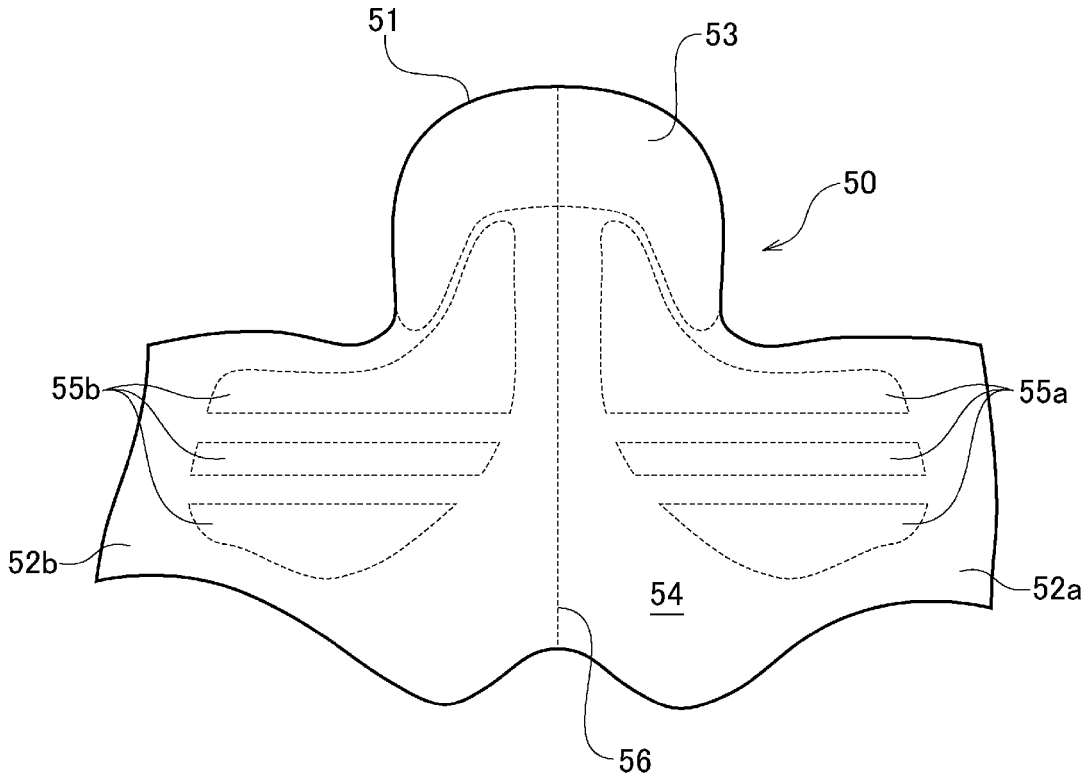
FIG. 13 is a bottom view of the shoe tongue in a spread state in an eighth embodiment.

FIG. 13 is a bottom view of the shoe tongue 50 in a spread state in the eighth embodiment. The eighth embodiment differs from the seventh embodiment in that, while the medial side high stretch region 55*a* is divided into multiple regions in the seventh embodiment, the lateral side high stretch region 55*b* is also divided into multiple regions. As with the medial side high stretch region 55*a*, the lateral side high stretch region 55*b* in the present embodiment also has a shape divided into multiple parts by multiple band-shaped slits provided along the left and right directions at positions corresponding to the midfoot portion of the wearer. Each slit portion is part of the medium stretch region 54 and has lower stretchability than the medial side high stretch region 55*a* and the lateral side high stretch region 55*b*. Further, a center portion along the ridge portion 56 is also not provided with a high stretch region. This can strengthen the tightening in the midfoot portion and restrain sidewise shifts of the foot.

In the present embodiment, the center portion along the ridge portion 56 is not provided with a high stretch region but may be provided, in a modification, with a central high stretch region similar to that in the first embodiment.

Ninth Embodiment

The present embodiment differs from the third embodiment in the shapes and arrangement of stretch regions in the shoe tongue 50. In the following, description will be given mainly for the differences from the third embodiment, and the explanation of features in common will be omitted.

Figure 14:
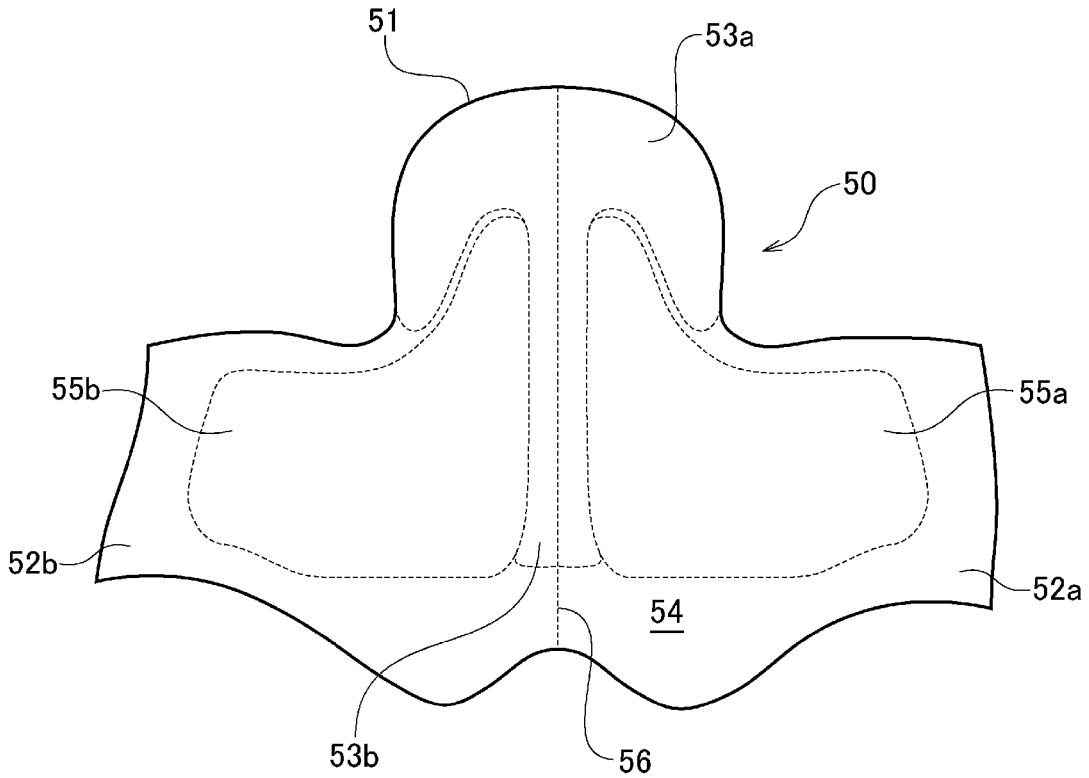
FIG. 14 is a bottom view of the shoe tongue in a spread state in a ninth embodiment.

FIG. 14 is a bottom view of the shoe tongue 50 in a spread state in the ninth embodiment. The low stretch region 53 is constituted by the crescent-shaped portion 53*a* and the central downward extending portion 53*b*, and the low stretch region 53 as a whole has a T-shape, in the same way as the low stretch region 53 of the third embodiment. Meanwhile, the present embodiment differs from the third embodiment in that the central downward extending portion 53*b* of the low stretch region 53 extends downward to a position near the lower end of the shoe tongue 50, i.e., a position near the lower ends of the medial side high stretch region 55*a* and the lateral side high stretch region 55*b*. The central downward extending portion 53*b* of the present embodiment is formed in a band shape that maintains almost the same width along the low stretch region 53 and extends downward to a position near the lower ends of the medial side high stretch region 55*a* and the lateral side high stretch region 55*b*. Also, the end on the ridge portion 56 side of the medial side high stretch region 55*a* extends leftward to a position near the ridge portion 56, i.e., a position adjacent to the central downward extending portion 53*b* without a gap. Similarly, the end on the ridge portion 56 side of the lateral side high stretch region 55*b* extends rightward to a position near the ridge portion 56, i.e., a position adjacent to the central downward extending portion 53*b* without a gap.

This can increase the thick region along the ridge portion 56 from the tip part 51 to a position near the lower end on the toe side, thereby further reducing the feeling of tightness on the instep when the shoelace 30 is tightened.

Tenth Embodiment

The present embodiment differs from the fifth embodiment in the shapes and arrangement of stretch regions in the shoe tongue 50. In the following, description will be given mainly for the differences from the fifth embodiment, and the explanation of features in common will be omitted.

Figure 15:
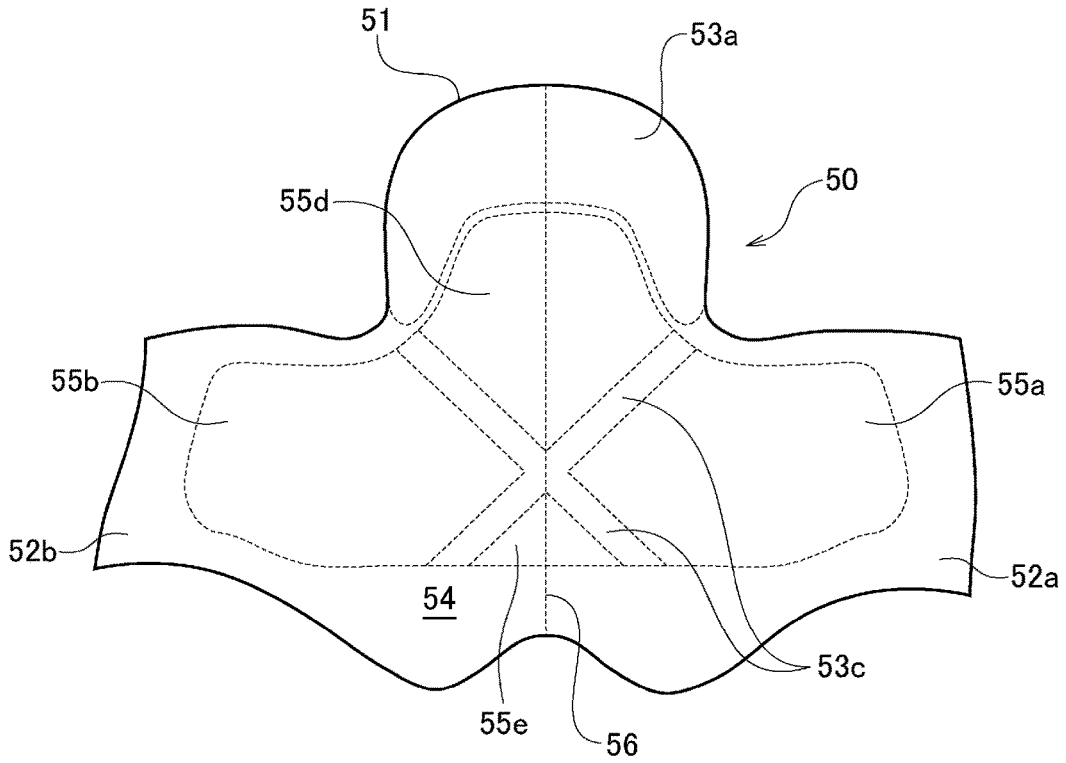
FIG. 15 is a bottom view of the shoe tongue in a spread state in a tenth embodiment.

FIG. 15 is a bottom view of the shoe tongue 50 in a spread state in the tenth embodiment. The overall contour of the high stretch region 55 in the present embodiment coincides with the overall contour of the high stretch region 55 in the fifth embodiment. Meanwhile, the present embodiment differs from the fifth embodiment in that a low stretch region formed by two band-shaped portions intersecting diagonally is provided in a center portion of the high stretch region 55. An intersecting band-shaped portion 53*c* is a low stretch region formed by two intersecting band-shaped portions extending diagonally downward respectively from positions near the lower ends on the both sides of the crescent-shaped portion 53*a* to the opposite sides across the ridge portion 56.

As with the crescent-shaped portion 53*a*, the intersecting band-shaped portion 53*c* is thicker than other adjacent portions.

The high stretch region 55 is divided into four regions by the intersecting band-shaped portion 53*c*. The four divided regions are, besides the medial side high stretch region 55*a* positioned on the medial side and the lateral side high stretch region 55*b* position on the lateral side, a central upper high stretch region 55*d* positioned in an upper part along the ridge portion 56, and a central lower high stretch region 55*e* positioned in a lower part along the ridge portion 56.

This can reduce the feeling of tightness in a top part of the midfoot portion due to tightening of the shoelace 30 and can also restrain sidewise shifts by wrapping around the midfoot portion more strongly.

Eleventh Embodiment

The present embodiment differs from the tenth embodiment in the shapes and arrangement of stretch regions in the shoe tongue 50. In the following, description will be given mainly for the differences from the tenth embodiment, and the explanation of features in common will be omitted.

Figure 16:
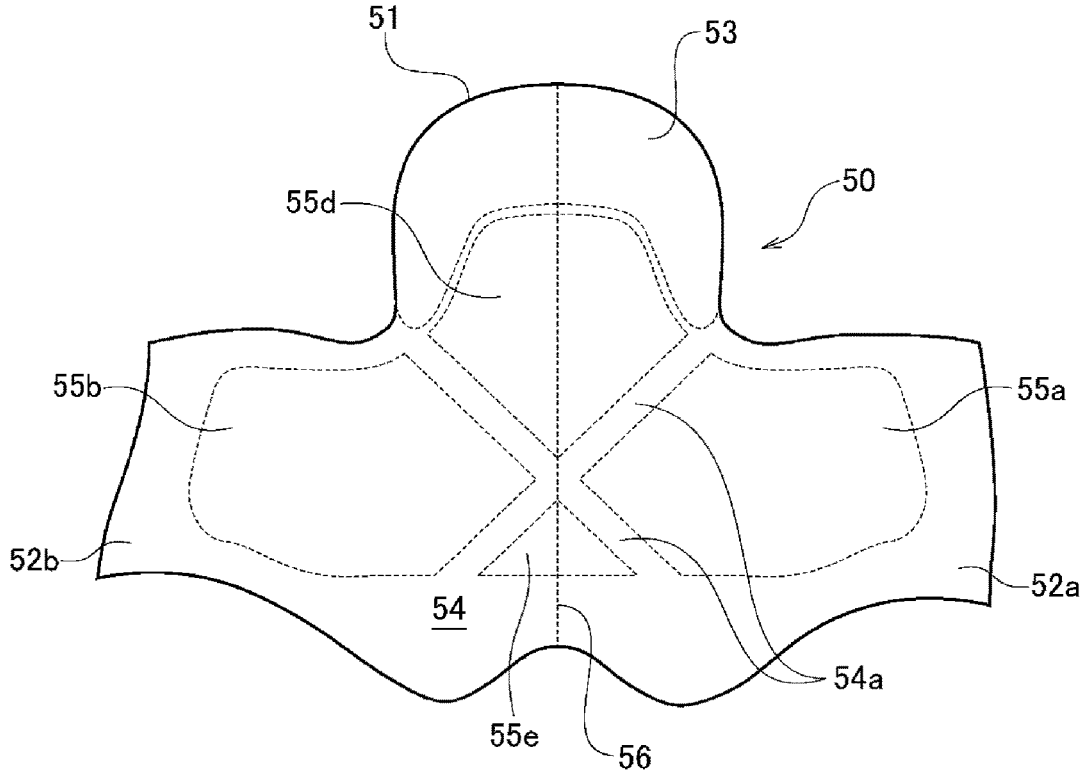
FIG. 16 is a bottom view of the shoe tongue in a spread state in an eleventh embodiment.

FIG. 16 is a bottom view of the shoe tongue 50 in a spread state in the eleventh embodiment. In the arrangement of the present embodiment, the low stretch region of the intersecting band-shaped portion 53*c* in the tenth embodiment is replaced with a medium stretch region. More specifically, an intersecting band-shaped portion 54*a* is provided, which is a medium stretch region formed by two intersecting band-shaped portions extending diagonally downward respectively from positions near the lower ends on the both sides of the crescent-shaped portion 53*a* to the opposite sides across the ridge portion 56.

The high stretch region 55 is divided into four regions by the intersecting band-shaped portion 54*a*. The four divided regions are, besides the medial side high stretch region 55*a* positioned on the medial side and the lateral side high stretch region 55*b* position on the lateral side, the central upper high stretch region 55*d* positioned in an upper part along the ridge portion 56, and the central lower high stretch region 55*e* positioned in a lower part along the ridge portion 56.

Also in the present embodiment, sidewise shifts can be restrained by wrapping around the midfoot portion more strongly, as in the tenth embodiment.

Twelfth Embodiment

The present embodiment differs from the third embodiment in the shapes and arrangement of stretch regions in the shoe tongue 50. In the following, description will be given mainly for the differences from the third embodiment, and the explanation of features in common will be omitted.

Figure 17:
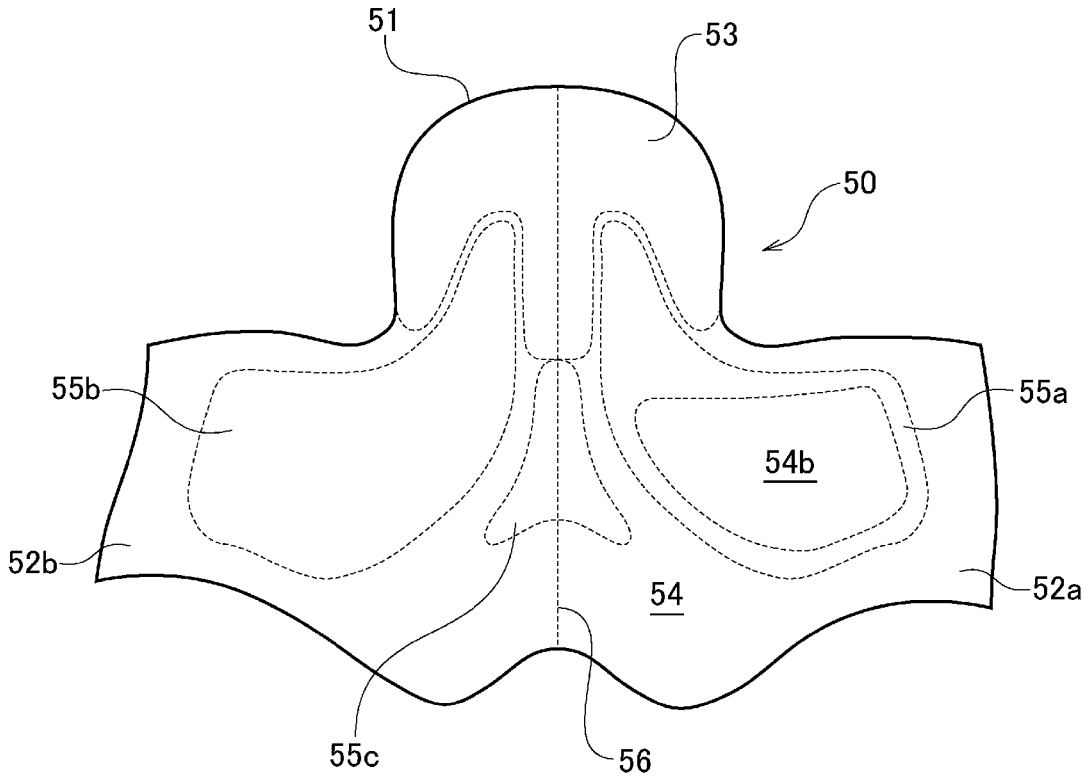
FIG. 17 is a bottom view of the shoe tongue in a spread state in a twelfth embodiment.

FIG. 17 is a bottom view of the shoe tongue 50 in a spread state in the twelfth embodiment. The present embodiment differs from the third embodiment in that a hollow part is formed in the medial side high stretch region 55*a* of the third embodiment to occupy most of an area from the vicinity of the ridge portion 56 toward the medial side end 52*a*, and, in the hollow part, a medium stretch region is provided as a medial side partial medium stretch region 54*b*.

The present embodiment can also make the medial side less stretchable and more rigid than the lateral side, thereby preventing excessive pronation due to collapse of the arch.

Thirteenth Embodiment

The present embodiment differs from the third embodiment in the shapes and arrangement of stretch regions in the shoe tongue 50. In the following, description will be given mainly for the differences from the third embodiment, and the explanation of features in common will be omitted.

Figure 18:
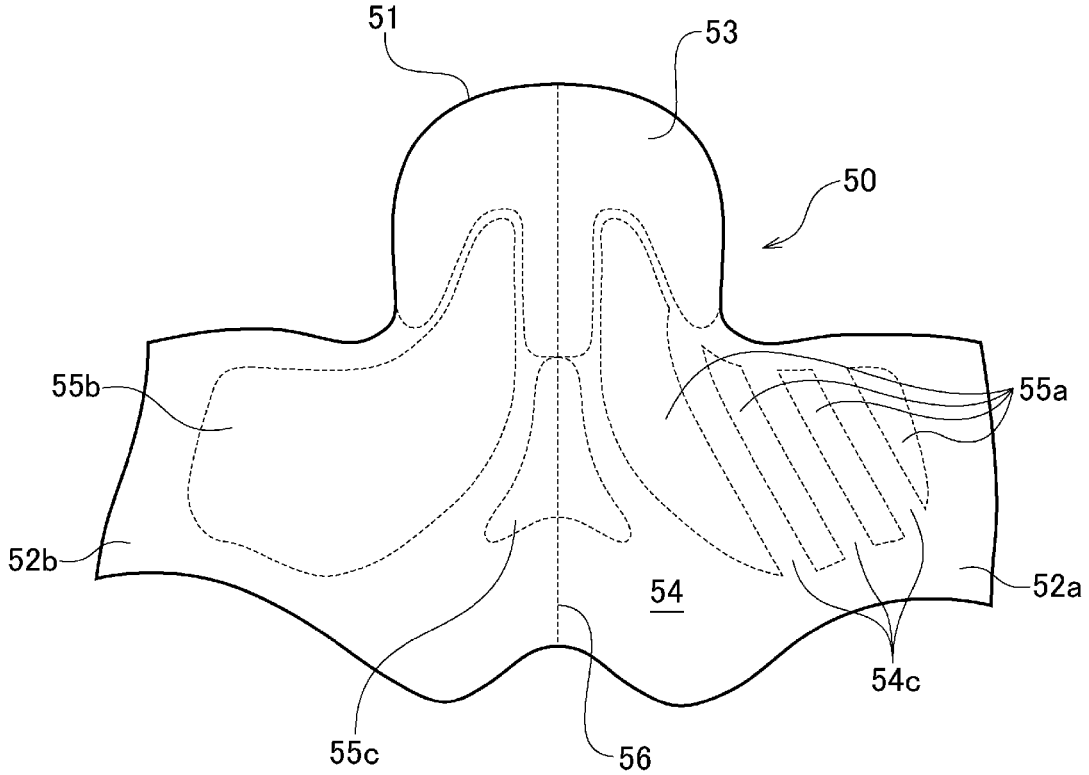
FIG. 18 is a bottom view of the shoe tongue in a spread state in a thirteenth embodiment.

FIG. 18 is a bottom view of the shoe tongue 50 in a spread state in the thirteenth embodiment. The present embodiment differs from the third embodiment in that the medial side high stretch region 55*a* is formed in a shape such that multiple diagonal slits are added to the medial side high stretch region 55*a* of the third embodiment. More specifically, the medial side high stretch region 55*a* of the present embodiment is divided into multiple regions by slit-shaped medium stretch regions 54*c*, which are three diagonal slits. The three slit-shaped medium stretch regions 54*c* constitute part of the medium stretch region 54. As a result, the medial side in the present embodiment as a whole is more stretchable than the medium stretch region 54 and less stretchable than the lateral side high stretch region 55*b*. The present embodiment can also make the medial side less stretchable and more rigid than the lateral side, thereby preventing excessive pronation due to collapse of the arch.

Fourteenth Embodiment

The present embodiment differs from the third embodiment in the shape of a stretch region in the shoe tongue 50. In the following, description will be given mainly for the differences from the third embodiment, and the explanation of features in common will be omitted.

Figure 19:
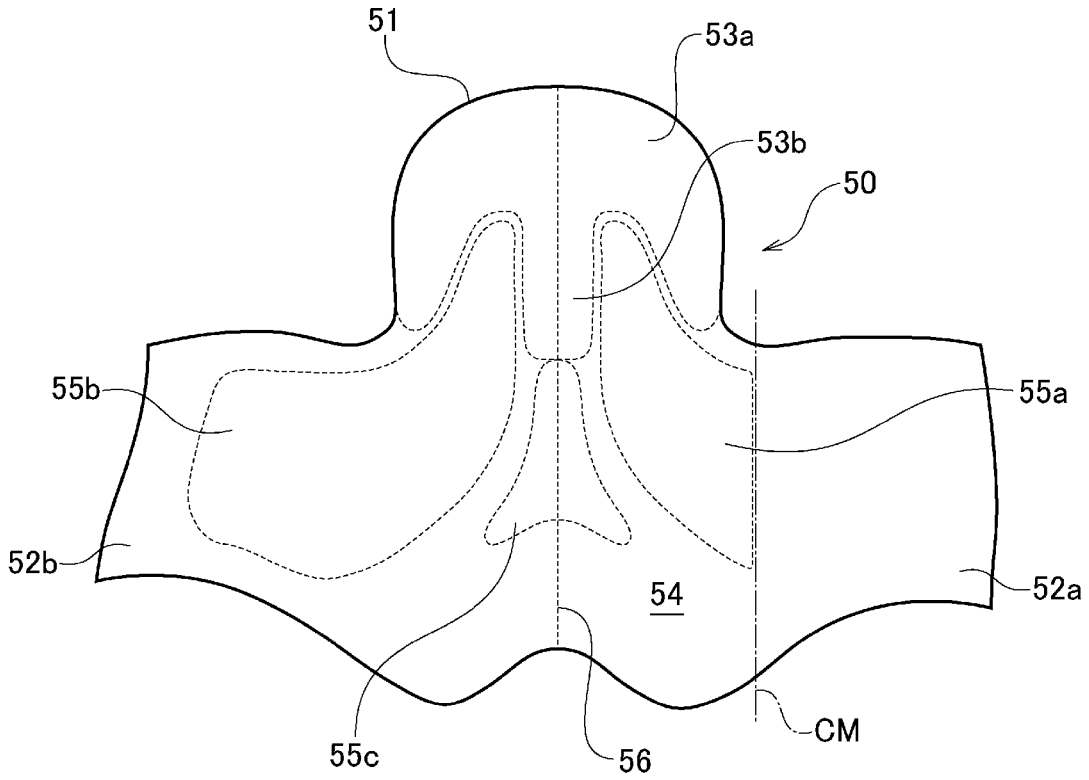
FIG. 19 is a bottom view of the shoe tongue in a spread state in a fourteenth embodiment.

FIG. 19 is a bottom view of the shoe tongue 50 in a spread state in the fourteenth embodiment. The medial side high stretch region 55*a* of the present embodiment is about half the size of the medial side high stretch region 55*a* of the third embodiment. More specifically, when the medial side high stretch region 55*a* of the third embodiment is divided into two halves by a virtual center line CM extending along the front and rear directions, the medial side high stretch region 55*a* of the present embodiment has a shape and size corresponding to the half of the ridge portion 56 side, and the half of the medial side of the virtual center line CM is not provided with a high stretch region and constitutes part of the medium stretch region 54. The present embodiment can also make the medial side less stretchable and more rigid than the lateral side, thereby preventing excessive pronation due to collapse of the arch.

Fifteenth Embodiment

The present embodiment differs from the third embodiment in the shape of a stretch region in the shoe tongue 50. In the following, description will be given mainly for the differences from the third embodiment, and the explanation of features in common will be omitted.

Figure 20:
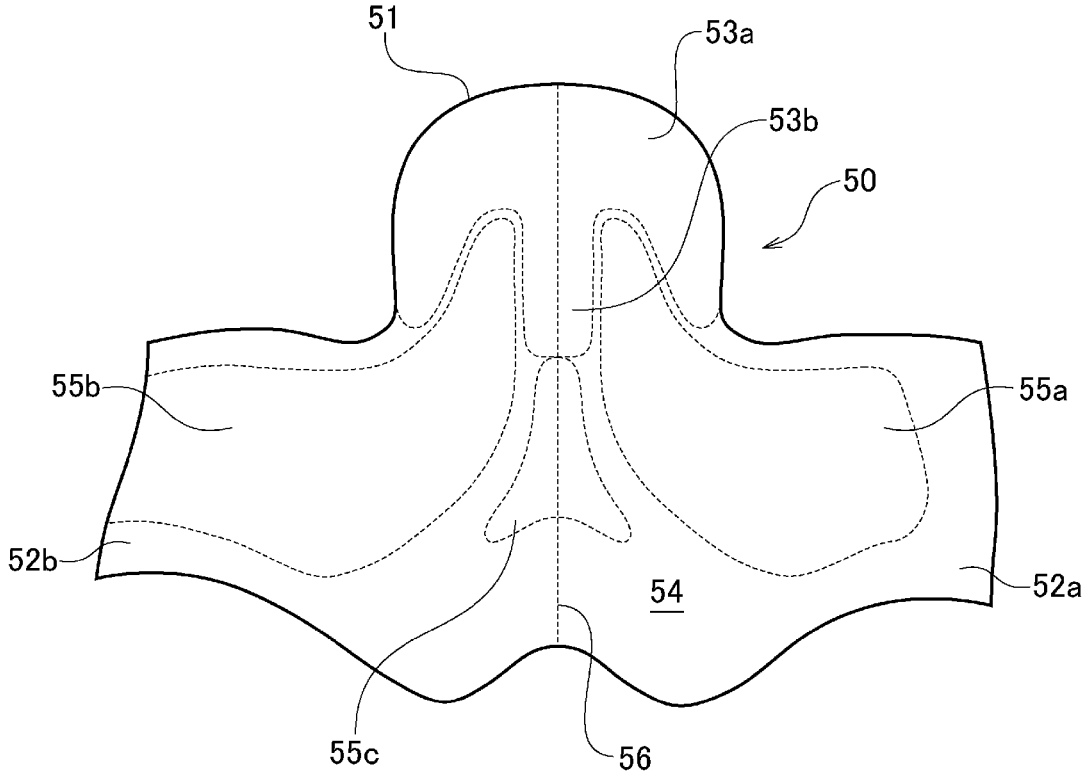
FIG. 20 is a bottom view of the shoe tongue in a spread state in a fifteenth embodiment.

FIG. 20 is a bottom view of the shoe tongue 50 in a spread state in the fifteenth embodiment. The lateral side high stretch region 55*b* of the present embodiment is larger than the lateral side high stretch region 55*b* of the third embodiment and extends leftward to an edge of the lateral side end 52*b*. The present embodiment can also make the medial side less stretchable and more rigid than the lateral side where the area of the high stretch region is larger, thereby preventing excessive pronation due to collapse of the arch.

Sixteenth Embodiment

The present embodiment differs from the third and fourteenth embodiments in the shape of a stretch region in the shoe tongue 50. In the following, description will be given mainly for the differences from the third and fourteenth embodiments, and the explanation of features in common will be omitted.

Figure 21:
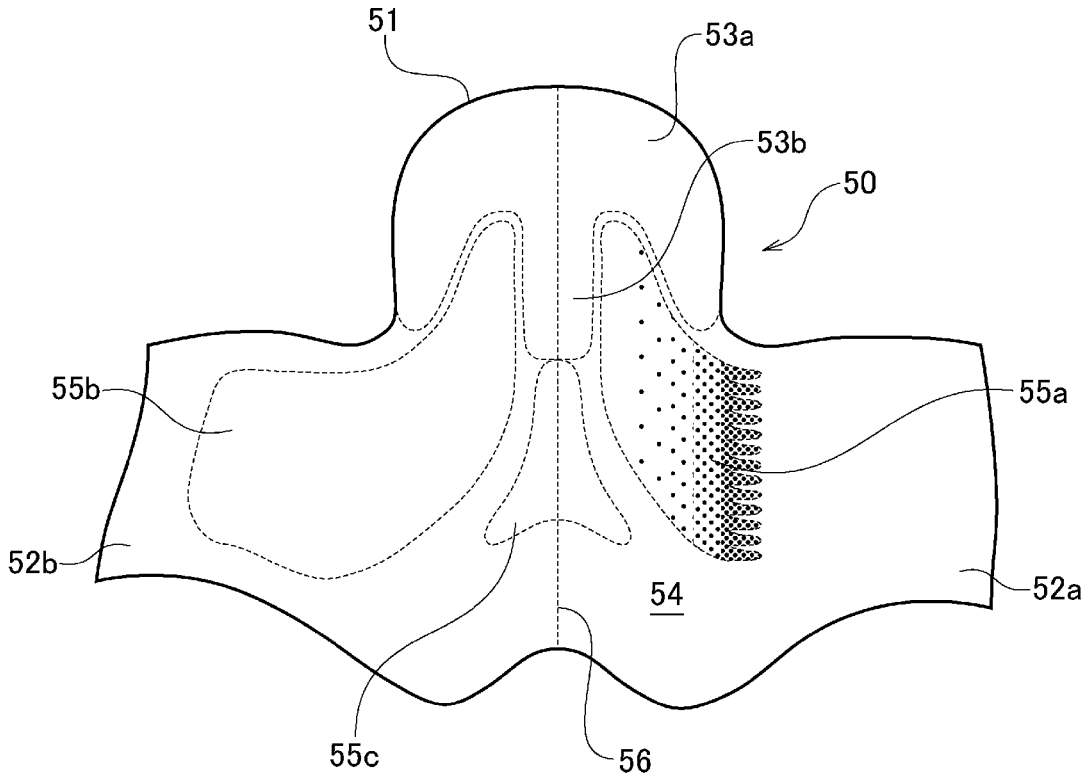
FIG. 21 is a bottom view of the shoe tongue in a spread state in a sixteenth embodiment.

FIG. 21 is a bottom view of the shoe tongue 50 in a spread state in the sixteenth embodiment. In the present embodiment, the medial side high stretch region 55*a* is about half the size of the medial side high stretch region 55*a* of the third embodiment, in the same way as in the fourteenth embodiment. However, the sixteenth embodiment differs from the fourteenth embodiment in that, while the boundary between the medial side end of the medial side high stretch region 55*a* and the medium stretch region in the fourteenth embodiment is clear, the boundary between the medial side end of the medial side high stretch region 55*a* and the medium stretch region in the sixteenth embodiment is formed in a gradation-like pattern to be made ambiguous. In other words, the medial side high stretch region 55*a* of the present embodiment is formed such that the stretchability thereof gradually decreases from the ridge portion 56 side toward the medial side. The present embodiment can also make the medial side less stretchable and more rigid than the lateral side, thereby preventing excessive pronation due to collapse of the arch. Also, since the shoe tongue is configured such that the stretchability thereof changes in stages from the high stretch region to the medium stretch region, the arch can be supported with less incongruity, and the fit can be improved.

Seventeenth Embodiment

The present embodiment differs from the fourth embodiment in the shape of a stretch region in the shoe tongue 50. In the following, description will be given mainly for the differences from the fourth embodiment, and the explanation of features in common will be omitted.

Figure 22:
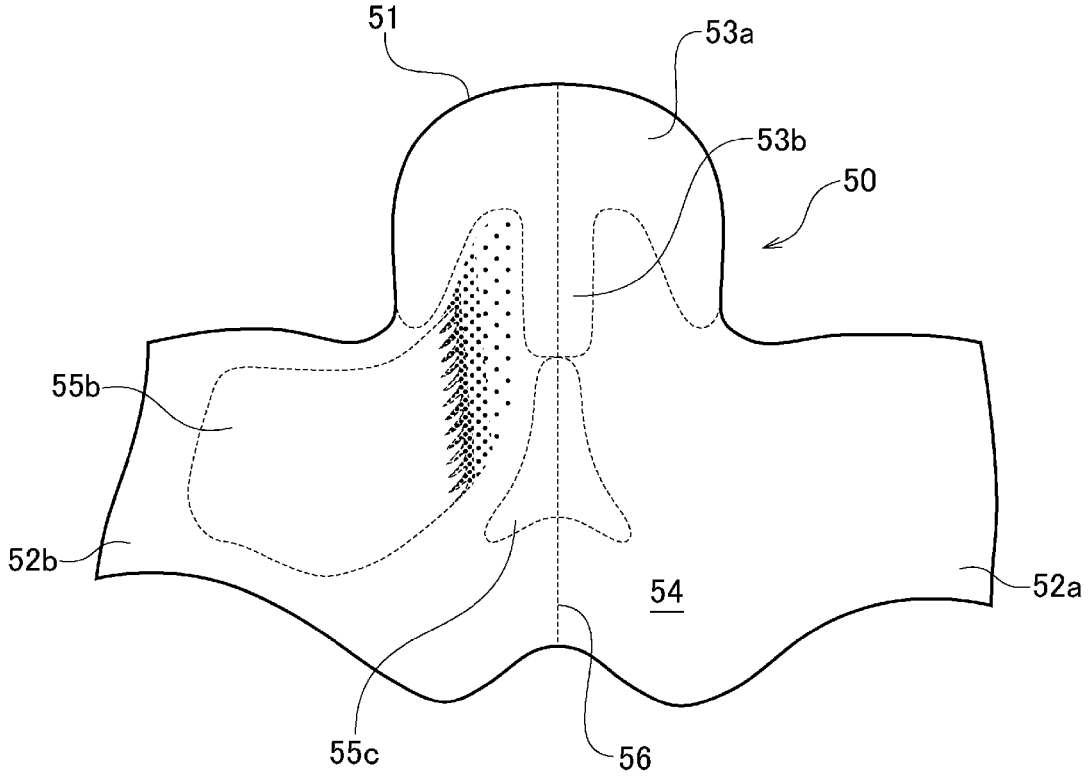
FIG. 22 is a bottom view of the shoe tongue in a spread state in a seventeenth embodiment.

FIG. 22 is a bottom view of the shoe tongue 50 in a spread state in the seventeenth embodiment. The present embodiment is the same as the fourth embodiment in that the medial side high stretch region is not provided, but the lateral side high stretch region 55*b* of the present embodiment is different in shape from the lateral side high stretch region 55*b* of the fourth embodiment. The lateral side high stretch region 55*b* of the present embodiment is formed such that the boundary with the adjacent medium stretch region is formed in a gradation-like pattern to be made ambiguous and such that the stretchability of the lateral side high stretch region 55*b* gradually decreases from the lateral side toward the ridge portion 56. The present embodiment can also make the medial side less stretchable and more rigid than the lateral side, thereby preventing excessive pronation due to collapse of the arch. Also, since the shoe tongue is configured such that the stretchability thereof changes in stages from the high stretch region to the medium stretch region, the stability of the midfoot portion can be enhanced with less incongruity, and the fit can be improved.

Eighteenth Embodiment

The present embodiment differs from the third embodiment in the shapes and arrangement of stretch regions in the shoe tongue 50. In the following, description will be given mainly for the differences from the third embodiment, and the explanation of features in common will be omitted.

Figure 23:
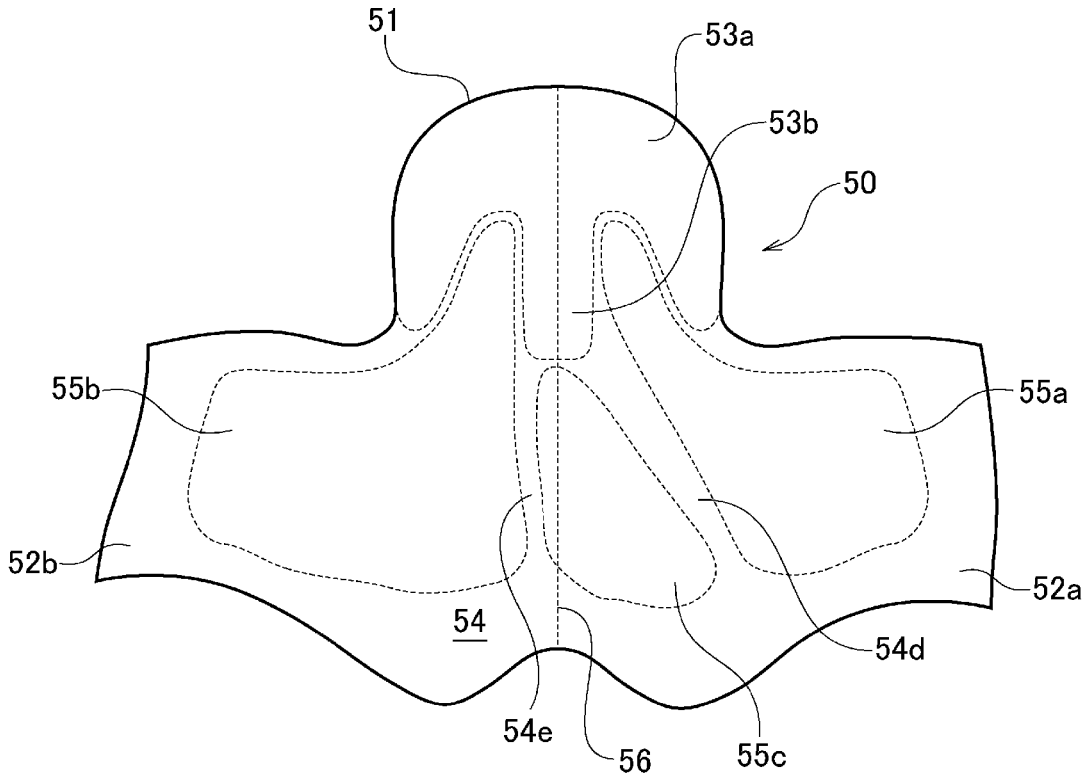
FIG. 23 is a bottom view of the shoe tongue in a spread state in an eighteenth embodiment.

FIG. 23 is a bottom view of the shoe tongue 50 in a spread state in the eighteenth embodiment. A prominent portion of instep bones of a human foot generally has a ridge extending diagonally downward toward the hallux or the medial side, with the apex around the center in a foot width direction in front of the ankle. The present embodiment differs from the third embodiment in that the medium stretch region between the medial side high stretch region 55*a*, lateral side high stretch region 55*b*, and central high stretch region 55*c* is disposed such as to flow from the center of the instep in front of the ankle toward the toe on the medial side, along the prominent portion of the bones. More specifically, a medial side band portion 54*d*, which is the medium stretch region between the medial side high stretch region 55*a* and the central high stretch region 55*c*, is disposed such as to flow diagonally downward from the vicinity of the central downward extending portion 53*b* toward the medial side. Also, a middle band portion 54*e*, which is the medium stretch region between the lateral side high stretch region 55*b* and the central high stretch region 55*c*, is disposed such as to flow downward in a middle part from below the central downward extending portion 53*b* along the ridge portion 56. As a result, the medial side high stretch region 55*a*, lateral side high stretch region 55*b*, and central high stretch region 55*c* divided by the medial side band portion 54*d* and middle band portion 54*e* are configured as a whole in a shape and arrangement such as to flow from the vicinity of the ridge portion 56 toward the medial side.

Accordingly, the medium stretch regions are disposed along the prominent portion of the instep bones, and, by arranging the high stretch regions on both sides of the medium stretch regions, the arrangement of stretch regions considering the foot bones can be made, thereby improving the fit to the instep.

Nineteenth Embodiment

The present embodiment differs from the eighteenth embodiment in the shapes and arrangement of stretch regions in the shoe tongue 50. In the following, description will be given mainly for the differences from the eighteenth embodiment, and the explanation of features in common will be omitted.

Figure 24:
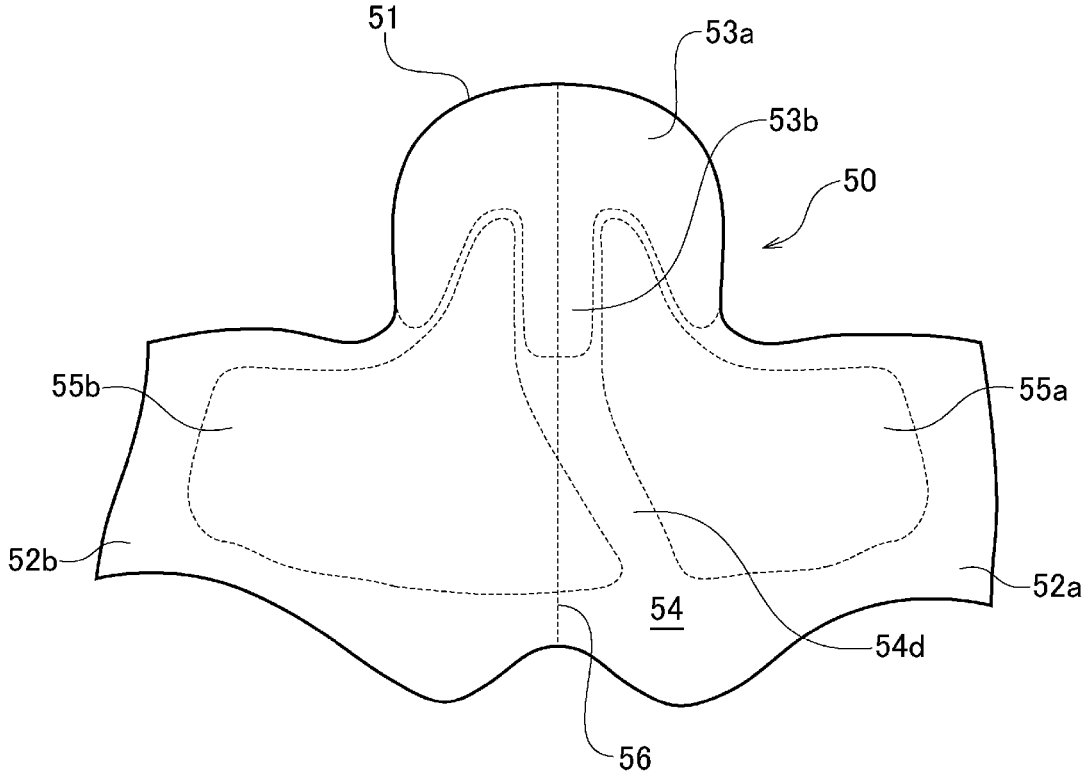
FIG. 24 is a bottom view of the shoe tongue in a spread state in a nineteenth embodiment.

FIG. 24 is a bottom view of the shoe tongue 50 in a spread state in the nineteenth embodiment. In the present embodiment, the stretch regions are arranged based on the prominent portion of the instep bones of a human foot such as to flow from the center of the instep in front of the ankle toward the toe on the medial side, in the same way as in the eighteenth embodiment. In the present embodiment, the medial side band portion 54*d* flowing from the vicinity of the ridge portion 56 toward the medial side is provided as a band-like medium stretch region, but a region like the middle band portion 54*e* in the eighteenth embodiment is not provided. In other words, the high stretch region of the present embodiment is divided into two parts by the medial side band portion 54*d* as the boundary and is constituted by the medial side high stretch region 55*a* occupying the medial side and the lateral side high stretch region 55*b* occupying the lateral side and a middle portion.

Also in the present embodiment, the medium stretch region is disposed along the prominent portion of the instep bones, and, by arranging the high stretch regions on both sides of the medium stretch region, the arrangement of stretch regions considering the foot bones can be made, thereby improving the fit to the instep.

The present disclosure has been described with reference to embodiments. The embodiments are intended to be illustrative only, and it will be obvious to those skilled in the art that various modifications to each constituting element and a combination of constituting elements could be developed and that such modifications also fall within the scope of the present disclosure.

The invention claimed is:

1. A shoe, comprising:

a sole;

an upper joined to the sole; and a shoe tongue provided in a space formed by the sole and the upper, the shoe tongue being formed of a knitted member and including a ridge portion of inverted V shape along a front-to-rear direction of the shoe, wherein the ridge portion includes a tip part formed in a crescent shape with both ends of the crescent shape extending from a top central part of the shoe tongue downward toward both a medial side and a lateral side of the shoe, wherein the shoe tongue further includes a first region and a second region, wherein the first region includes a first portion and a second portion, wherein the first portion of the first region is adjacent to the tip part and to the second region such that the first portion of the first region intervenes between the tip part and the second region, wherein the second portion of the first region is adjacent to the second region without being adjacent to the tip part, wherein, in a cross-sectional view, the tip part, the first portion of the first region, the second region, and the second portion of the first region are disposed in the recited order, and wherein a thickness of the tip part is greater than a thickness of the first region while the thickness of the first region is greater than a thickness of the second region.

2. The shoe according to claim 1, wherein the shoe tongue is formed of a single knitted member of sheet shape of which side ends on the medial side and the lateral side are each joined to a vicinity of a tangent between a bottom part and a side part in the space.

3. The shoe according to claim 2, wherein, in the shoe tongue, part of an area from the ridge portion to the side end on the medial side or the lateral side is formed to have higher stretchability than at least part of other adjacent areas.

4. The shoe according to claim 3, wherein the shoe tongue includes a recess formed in an arc shape on part of a circumferential edge that continues from the tip part of the shoe tongue to each of side ends on the medial side and the lateral side, and an arc degree of the arc forming the recess is smaller than $\pi$ radian.

5. The shoe according to claim 2, wherein the shoe tongue includes a recess formed in an arc shape on part of a circumferential edge that continues from the tip part of the shoe tongue to each of side ends on the medial side and the lateral side, and an arc degree of the arc forming the recess is smaller than $\pi$ radian.

6. The shoe according to claim 1, wherein, in the shoe tongue, part of an area from the ridge portion to a side end on the medial side or the lateral side is formed to have higher stretchability than at least part of other adjacent areas.

7. The shoe according to claim 6, wherein the shoe tongue includes a recess formed in an arc shape on part of a circumferential edge that continues from the tip part of the shoe tongue to each of side ends on a medial side and a lateral side, and an arc degree of the arc forming the recess is smaller than $\pi$ radian.

8. The shoe according to claim 1, wherein the shoe tongue includes a recess formed in an arc shape on part of a circumferential edge that continues from the tip part of the shoe tongue to each of side ends on the medial side and the lateral side, and an arc degree of the arc forming the recess is smaller than $\pi$ radian.

9. The shoe according to claim 1, wherein a thick portion of the tip part is formed in a crescent shape in plan view, and both ends of the crescent shape each extend toward a toe.

* * * * *